US005827632A

United States Patent [19]

Inaba et al.

[11] Patent Number: 5,827,632

[45] Date of Patent: Oct. 27, 1998

[54] TONER FOR DEVELOPING ELECTROSTATIC IMAGE CONTAINING HYDROPHOBIZED INORGANIC FINE POWDER

[75] Inventors: Kohji Inaba, Yokohama; Tatsuya Nakamura, Tokyo; Tatsuhiko Chiba, Kamakura; Takao Ishiyama, Kawasaki, all of Japan

[73] Assignee: Canon Kabushiki Kaisha, Tokyo, Japan

[21] Appl. No.: 909,877

[22] Filed: Aug. 12, 1997

Related U.S. Application Data

[63] Continuation-in-part of Ser. No. 566,542, Dec. 4, 1995, abandoned.

[30] Foreign Application Priority Data

Dec. 5, 1994 [JP] Japan ..... 6-329298

[51] Int. Cl.[6] ..... G03G 9/097

[52] U.S. Cl. ..... 431/110; 430/111

[58] Field of Search ..... 430/110, 111

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/64 |
| 4,623,605 | 11/1986 | Kato et al. | 430/110 |
| 4,626,487 | 12/1986 | Mitsuhashi et al. | 430/109 |
| 5,212,039 | 5/1993 | Demizu et al. | 430/122 |
| 5,219,696 | 6/1993 | Demizu et al. | 430/110 |
| 5,296,324 | 3/1994 | Akagi et al. | 430/111 |
| 5,342,876 | 8/1994 | Abe et al. | 430/110 |

FOREIGN PATENT DOCUMENTS

| | | | |
|---|---|---|---|
| 0617336 | 9/1994 | European Pat. Off. | G03G 9/087 |
| 36-10231 | 7/1961 | Japan . | |
| 56-13945 | 1/1981 | Japan . | |
| 59-53856 | 3/1984 | Japan . | |
| 56-61842 | 4/1984 | Japan . | |

OTHER PUBLICATIONS

Database WPI, Week 9443, Derwent Publ. No. AN94–344332 (1994).

Database WPI, Week 9434, Derwent Publ. No. AN94–276360 (1994).

Database WPI, Week 9325, Derwent Publ. No. AN93–201354 (1993).

Fedors, A Method of Estimating . . . of Liquids, Polym. Eng. & Sci., vol. 14, No. 2, Feb. 1974, pp. 147–154.

Lee et al., "The Glass Transition Temperaturs of Polymers", Polymer Handbook, 2nd Ed., by John Wiley & Sons, pp. (III–179)–(III–192).

*Primary Examiner*—Christopher D. Rodee

*Attorney, Agent, or Firm*—Fitzpatrick, Cella, Harper & Scinto

[57] ABSTRACT

A toner for developing electrostatic images includes (a) toner particles having a weight-average particle size of 1–9 μm, (b) hydrophobized inorganic fine powder having an average particle size of 10–90 nm and (c) hydrophobized silicon compound fine powder. The hydrophobized silicon compound fine powder has an average particle size of 30–120 nm, and a particle size distribution such that it contains 15–45% by number of particles having sizes of 5–30 nm, 30–70% by number of particles having sizes of 30–60 nm and 5–45% by number of particles having sizes of at least 60 nm. The hydrophobized silicon compound fine powder having a broad particle size distribution including coarse particles functions to prevent the embedding of the hydrophobized inorganic fine powder (functioning as a flowability improver) from being embedded at the toner particle surfaces, whereby the toner is allowed to exhibit stable performances even in a continuous image formation on a large number of sheets.

21 Claims, 7 Drawing Sheets

TONER FOR DEVELOPING ELECTROSTATIC IMAGE CONTAINING HYDROPHOBIZED INORGANIC FINE POWDER

This application is a continuation-in-part of application Ser. No. 08/566,542 filed Dec. 4, 1995, now abandoned.

FIELD OF THE INVENTION AND RELATED ART

The present invention relates to a toner for developing electrostatic images for use in electrophotography or electrostatic recording.

Hitherto, various electrophotographic processes have been known as disclosed in U.S. Pat. Nos. 2,297,691, 3,666,363, 4,071,361, etc. In these processes, an electrostatic latent image is formed on a photosensitive member comprising a photoconductor by various means and then developed with a toner. The resultant toner image, after being optionally transferred onto a transfer-receiving material such as paper, is fixed by heating, pressure application, heating and pressure application or treatment with a solvent vapor to obtain a copy or a print. The residual toner remaining on the photosensitive member without being transferred is cleaned by various means, and the above steps are repeated. As a cleaning means, a blade cleaning means comprising a cleaning blade of a rubbery elastic material to be pressed against the photosensitive member has been widely used because of a simple structure, a compact size and an economical advantage.

In recent years, such an image forming apparatus is being used not only as an office-use copying machine for reproducing originals but also as a printer for computer outputs and a personal copier.

In addition to printers as represented by laser beam printers, there has been made a rapid progress also in the field of plain paper facsimile apparatus. Accordingly, such image forming apparatus are required to be small in size and light in weight and provide high image quality and high reliability. As a result, the toner used therefor is required to show higher and improved performances.

As a measure for accomplishing high image quality, it has been proposed to use a toner of a smaller particle size but a toner of a smaller particle size is liable to cause a slippage or passing-by of the toner between the photosensitive member and the cleaning blade, thus causing a cleaning failure. For this reason, various measures have been taken, such as an increased contact pressure between the photosensitive member and the cleaning blade or an increased frictional coefficient with the photosensitive member by changing the cleaning blade material. These measures are however liable to be accompanied with difficulties, such as the occurrence of a breakage at the cleaning blade edge, and turn-over of the cleaning blade if the blade is disposed so as to oppose the movement of the photosensitive member. Further, on continuation of image formation on a large number of sheets, damages such as scars or mars or filming of a toner material are liable to occur on the surface of the photosensitive member, thus resulting in image quality deterioration.

Accordingly, a toner is required to satisfy a smaller particle size and a cleanabilty for providing a high reliability in combination.

Further, a small particle size-toner tends to have a large triboelectric charge and therefore provides a difficulty in transferring. Accordingly, the improvement in transferability of toner image from the photosensitive member surface to a transfer-receiving material or from the photosensitive member surface to an intermediate transfer member and from the intermediate transfer member to the transfer-receiving material, becomes an important factor for providing an improved image quality and reducing the load on the cleaning step.

U.S. Pat. No. 4,626,487 (corr. to Japanese Laid-Open Patent Appln. (JP-A) 60-32060) has proposed the use of both inorganic fine powder having a large BET specific surface area and inorganic fine powder having a small BET specific surface area in mixture with toner particles. However, accompanying the use of a toner of a smaller particle size, a toner having better transferability and better cleanability has been desired.

SUMMARY OF THE INVENTION

A generic object of the present invention is to provide a toner for developing electrostatic images having solved the above-mentioned problems.

A more specific object of the present invention is to provide a toner for developing electrostatic images showing excellent performances in continuous image formation on a large number of sheets.

Another object of the present invention is to provide a toner for developing electrostatic images showing a high transfer efficiency.

Another object of the present invention is to provide a toner for developing electrostatic images showing excellent cleanability.

A further object of the present invention is to provide a toner for developing electrostatic images causing little deterioration of external additives during a continuous image formation on a large number of sheets.

According to the present invention, there is provided a toner for developing electrostatic images, comprising: (a) toner particles having a weight-average particle size of 1–9 $\mu$m, (b) hydrophobized inorganic fine powder having an average particle size of 10–90 nm and (c) hydrophobized silicon compound fine powder;

wherein the hydrophobized silicon compound fine powder has an average particle size of 30–120 nm, and a particle size distribution such that it contains 15–45% by number of particles having sizes of 5–30 nm, 30–70% by number of particles having sizes of 30–60 nm and 5–45% by number of particles having sizes of at least 60 nm.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
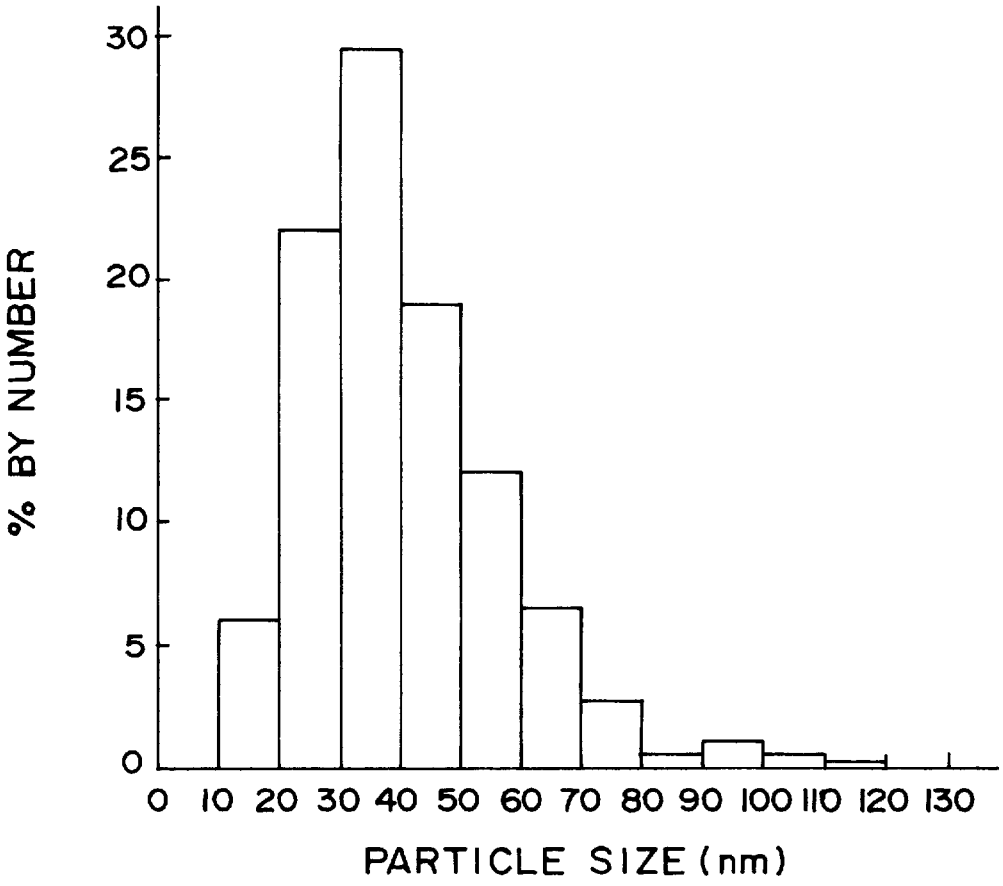
FIGS. 1 to 4 are graphs showing a particle size distribution of hydrophobized silica fine powder (A) to (D), respectively.

As a measure for improving the image quality, it has been known to use toner particles of a smaller particle size. However, if the toner particles are reduced in size to provide a small average particle size, the resultant toner particle are caused to have a lower flowability and a lower transfer ratio in the transfer step. For this reason, a flowability-improving agent, such as silica fine powder, may be used for improving the toner particles of a small average particle size. However, in a continuous image formation on a large number of sheets, the flowability improving agent is liable to be embedded at the surfaces of toner particles and the resultant toner particles having a lowered flowability are accumulated without being used in the developer vessel, thus providing lower performances to the toner. Further, unused toner particles of a small average particle size provide a difficulty in good removal thereof from the electrostatic image-bearing member, such as a photosensitive member when employing a cleaning member, such as a cleaning blade or a cleaning roller in the cleaning step continually for a long period, thus being liable to cause cleaning failure.

In the present invention, hydrophobized inorganic fine powder having an average particle size of 10–90 nm is added as a flowability improver to toner particles having a weight-average particle size of 1–9 $\mu$m and, in order to retain the addition effect of the hydrophobized inorganic fine powder for a long period, there is further added hydrophobized silicon compound fine powder having an average particle size of 30–120 nm and a broad particle size distribution such that it contains 15–45% by number of particles having sizes of 5–30 nm, 30–70% by number of particles having sizes of 30–60 nm and 5–45% by number of particles having sizes of at least 60 nm.

The toner particles used in the present invention have a weight-average particle size of 1–9 $\mu$m (preferably 2–8 $\mu$m) providing high quality images by faithfully reproducing analog latent images or minute latent dot images. It is further preferred that the toner particles have a number-basis variation coefficient of particle size (A or $A_{VN}$) of at most 35%. Toner particles having a weight-average particle size of below 1 $\mu$m are liable to leave much transfer residue particles on an electrostatic image-bearing member such as a photosensitive member or an intermediate transfer member and provide images with irregularity due to fog and transfer failure, thus being unsuitable as a toner used in the present invention. In case where the toner particles have a weight-average particle size in excess of 9 $\mu$m, the toner is liable to cause melt-sticking onto the photosensitive member surface and the intermediate transfer member. These difficulties are liable to be promoted if the toner particles have a number-basis particle size variation coefficient in excess of 35%.

The particle size distribution of toner particles may be measured in various manners but the data referred to herein are based on the measurement by using a Coulter counter ("Model TA-II" or "MULTISIZER", respectively available from Coulter Electronics, Inc.) in the following manner.

More specifically, to a Coulter counter, an interface (available from Nikkaki K.K.) for outputting a number-basis distribution and a volume-basis distribution and a personal computer ("CX-1", available from Canon K.K.) are connected. An electrolyte liquid may be prepared as a ca. 1%-NaCl aqueous solution by using reagent-grade sodium chloride or a commercial electrolyte liquid (e.g., "ISOTON II", available from Coulter Scientific Japan K.K.) may be used. Into 100–150 ml of such an electrolyte liquid, 0.1–5 ml of a surfactant (preferably, an alkylbenzenesulfonic acid salt) is added, and further 2–20 mg of a toner sample is added. The sample suspended in the electrolyte liquid is subjected to a dispersion treatment by an ultrasonic disperser for 1–3 min. Then, the sample liquid is supplied to the Coulter counter with an aperture size of 100 $\mu$m or 50 $\mu$m to obtain a number basis particle size distribution in the range of 2–40 $\mu$m or 1–20 $\mu$m, from which the parameters characterizing the toner according to the present invention may be derived.

A number-basis particle size variation coefficient A or $A_{AN}$ (%) of toner particles may be calculated by the following equation:

$$A \text{ or } A_{VN}\ (\%)=[S/D_1/\times 100,$$

wherein S denotes a standard deviation in number-basis particle size distribution of toner particles, and $D_1$ denotes a number-average particle size ($\mu$m) of toner particles.

The toner particles used in the present invention comprise a binder resin, which may be styrene-(meth)acrylate copolymer, polyester resin or styrene-butadiene copolymer. In a process for directly producing toner particles by polymerization, the monomers of the above resins may preferably be used. Specific examples thereof may include: styrene; styrene derivatives, such as o- (m-, or p-)-methylstyrene, and m- (or para-)-ethylstyrene; (meth) acrylate ester monomers, such as methyl(meth)-acrylate, ethyl(meth)acrylate, propyl(meth)acrylate, butyl(meth) acrylate, octyl(meth)acrylate, dodecyl(meth)acrylate, stearyl (meth)acrylate, behenyl(meth)acrylate, 2-ethylhexyl(meth) acrylate, dimethylaminoethyl(meth)acrylate, and diethylaminoethyl(meth)acrylate; and other vinyl monomers, such as butadiene, isoprene, cyclohexene, (meth)acrylonitrile, and acrylamide. These monomers may be used singly or in mixture so as to provide a polymer with a theoretical glass transition temperature (as described in "Polymer Handbook" (2nd Edition III), p.p. 139–192 (published from John Wiley & Sons Inc.) in the range of 40°–75° C. If the glass transition temperature is below 40° C., the resultant toner is liable to have lower storage stability and lower performances in continuous image formation. On the other hand, in excess of 75° C., the toner is caused to have a high fixable temperature and is liable to provide an inferior color reproducibility because of insufficient mixing of the respective color toners particularly in the case of full-color image formation, and further liable to result in an OHP transparency with poor clarity.

The molecular weight of the binder resin may be measured by gel permeation chromatography (GPC). In the case of a toner having a core-shell structure, the GPC measurement may be performed by preliminarily subjecting the toner to 20 hours of extraction with solvent toluene by using a Soxhlet's extractor, followed by distilling-off of the toluene by a rotary evaporator to recover an extract, and sufficiently washing the extract with an organic solvent (e.g., chloroform) capable of dissolving a low-softening point substance but not an outer shell resin to recover a residue. The residue is dissolved in tetrahydrofuran (THF) and the solution is filtered by a solvent-resistant membrane filter having a pore diameter of 0.3 $\mu$m to recover a sample solution (THF solution), which is then subjected to GPC by using a GPC apparatus ("150C", available from Waters Co.) and a combination of plural columns (e.g., A-801, 802, 803, 804, 805, 806 and 807; available from Showa Denko K.K.) to obtain a molecular weight distribution with reference to a calibration curve prepared based on standard polystyrene samples. The binder resin used in the present invention may preferably show a molecular weight distribution measured in this manner such that it shows a number-average molecular weight (Mn) of $5\times10^3$ to $10^6$, and a weight-average molecular weight (Mw) providing a ratio (Mw/Mn) of 2–100.

The colorants used in the present invention may include yellow colorant, magenta colorant and cyan colorant described below, and also black colorant which may comprise carbon black, magnetic material or a black colored mixture of yellow/magenta/cyan colorants described below.

The yellow colorants may representatively include: condensed azo compounds, isoindolinone compounds, anthraquinone compounds, azo metal complexes, methine compounds, and arylamine compounds. Specific examples thereof may suitably include: C.I. Pigment Yellow 12, 13, 14, 15, 17, 62, 74, 83, 93, 94, 95, 109, 110, 111, 128, 129, 147, 168 and 180.

The magenta colorants may representatively include: condensed azo compounds, diketopyropyrrole compounds, anthraquinone, quinacridone compounds, basic dye lake compounds, naphthol compounds, benzimidazolone compounds, thioindigo compounds, and perylene compounds. Particularly preferred specific examples may include: C.I. Pigment Red 2, 3, 5, 6, 7, 23, 48:2, 38:3, 48:4, 57:1, 81:1, 144, 1,46, 166, 169, 177, 184, 185, 202, 206, 220, 221 and 254.

The cyan colorants may representatively include: copper phthalocyanine compounds, and derivatives thereof, anthraquinone compounds and basic dye lake compounds. Particularly suitable specific examples thereof may include: C.I. Pigment Blue 1, 7, 15, 15:1, 15:2, 15:3, 15:4, 60, 62 and 66.

The colorants may be used singly, in mixture or in a solid solution state. The colorants may be appropriately selected in view of factors, such as hue, saturation, brightners, weather resistance, OHP transparency, and dispersibility in toner particles. Such a colorant may be added in 1–20 wt. parts per 100 wt. parts of the binder resin.

Magnetic material as a black colorant, unlike the other colorants, may preferably be used in 40–150 wt. parts per 100 wt. parts of the binder resin.

The charge control agent used in the present invention may be known one, which is preferably colorless, provides a fast charging speed to the toner and allows the toner to stably retain a constant charge. In case where the toner is prepared by direct polymerization, it is preferred to use a charge control agent which little hinders the polymerization and is little soluble in the aqueous medium. Specific examples of negative charge control agent may include: salicylic acid, alkylsalicylic acid, dialkylsalicylic acid, naphthoic acid, dicarboxylic acid metal compounds, sulfonic acid, polymeric compounds having a carboxylic group in a side chain thereof, boron compounds, urea compounds, silicon compounds, and calixarene. Examples of the positive charge control agents may include: quaternary ammonium salts, polymeric compounds having a quaternary ammonium salt in a side chain thereof, quanidine compounds, and imidazole compounds. The charge control agent may preferably be added in 0.5–10 wt. parts per 100 wt. parts of the resin. However, the addition of a charge control agent is not essential, and the addition of such a charge control agent in toner particles can be omitted, e.g., by utilizing triboelectrification with a carrier in the two-component developing system or positive utilization of triboelectrification with a blade member or a sleeve member.

In order to provide a toner with improved fixability and anti-offset characteristic, it is preferred to add a release agent in toner particles. The release agent may preferably comprise a low-softening point compound having a softening point of 40°–150° C. It is further preferred to use compound showing a principal heat absorption peak temperature (hereinafter also called a "melting point") of 30°–120° C., more preferably 40°–150° C., on a DSC curve as measured according to ASTM D3418-8. If the peak temperature is below 30° C., the release agent shows a weak self-cohesion force, thus being liable to result in a weak anti-high-temperature offset resistance. On the other hand, if the peak temperature exceeds 120° C., the fixing temperature becomes high and it becomes difficult to appropriately smoothen the fixed image surface, thus resulting in a lower color-mixing characteristic. Further, in the production of toner particles by direct polymerization, the release agent is liable to precipitate during the particle formation in an aqueous medium for particle formation and polymerization in case of a high peak temperature.

The heat absorption peak temperature of the release agent may be measured by using a differential scanning calorimeter (e.g., "DSC-7", available from Perkin-Elmer Corp.). The temperature correction at the detector may be performed by using the melting points of indium and zinc, and the correction of heat capacity may be performed based on the melting of indium. The sample is placed on an aluminum pan and subjected to DSC at a temperature raising rate of 10° C./min. with a blank pan as a control.

Examples of the release agent may include: paraffin wax, polyolefin wax, polymethylene wax such as Fischer-Tropsch wax, amide wax, higher fatty acid, higher fatty acid metal salt, long-chain alkyl alcohol, ester wax, and derivatives of these (e.g., grafted products and block compounds thereof).

A toner used in a full color copying machine is required to include respective color toners which may cause sufficient color mixing in the fixing step so as to provide an improved color reproducibility and the transparency of an OHP image. Compared with a black toner, a color toner is generally preferred to comprise a resin which melts sharply and has a low molecular weight. An ordinary black toner generally uses a release agent having a relatively high crystallinity as represented by polyethylene wax or polypropylene wax so as to improve the anti-high-temperature offset characteristic in the fixing step. However, such a crystalline release agent, when used in a full-color toner, is liable to provide inferior clarity of OHP transparency image. For this reason, an ordinary color toner contains no release agent but the improvement in anti-high-temperature offset characteristic thereof has been effected by uniform application of silicone oil, etc., onto a heat-fixing roller. However, a copy or print product having a fixed toner image obtained in this manner is liable to provide an unpleasant feeling to a user because of excessive silicone oil, etc. on the surface.

Accordingly, as a release agent used in a color toner, it is preferred to use an ester wax having at least one (preferably two or more) long-chain alkyl group having at least 10, preferably at least 18, carbon atoms so as to provide an anti-high-temperature offset characteristic without hindering the clarity of OHP images.

In recent years, there has been an increasing demand for formation of full-color image on both sides of a recording sheet (transfer paper). In the formation of such both side images, a transfer paper having a toner image first formed on its front side is again passed through a fixing device for formation of an image on its back side, so that a further consideration should be paid to the high-temperature-offset characteristic of the toner. For this reason, it is preferred to add a release agent in the present invention. More specifically, it is preferred to add 5–40 wt. parts, more preferably 10–40 wt. parts, of a release agent per 100 wt. parts of the binder resin. Below 5 wt. parts, it is insufficient to provide an anti-high-temperature offset characteristic and an offset phenomenon is liable to occur in fixing for image formation on a back-side during the both-side image formation. In excess of 40 wt. parts, the melt sticking of toner onto an apparatus is liable to occur during a pulverization step for toner production, or the coalescence of toner particles is liable to occur during particle formation for toner production according to the polymerization process, thus resulting in toner particles having a broad particle size distribution.

The toner particles used in the present invention may be produced through a pulverization process wherein raw materials including a binder resin, a release agent, a colorant and a charge control agent are subjected to a uniform dispersion by a pressure kneader, an extruder or a media disperser, and the resultant kneaded mixture is pulverized to a prescribed toner particle size mechanically or by impingement onto a target in a jet stream, followed by an optional step of smoothening and sphering toner particles and further by a classification step for providing a sharper particle size distribution. The toner particles may also be prepared by a method of spraying a melt-mixture of the toner ingredients into air by a disk or multi-fluid nozzle as disclosed in Japanese Patent Publication (JP-B) 56-13945; a process of directly producing a toner by suspension polymerization as disclosed in JP-B 36-10231, Japanese Laid-Open Patent Appln. (JP-A) 59-53856 and JP-A 59-61842; a dispersion polymerization process for directly producing a toner in an aqueous organic solvent in which a monomer is soluble but the resultant polymer is insoluble; or an emulsion polymerization process as represented by a soap-free polymerization process wherein a toner is produced by direct polymerization in the presence of a water-soluble polar polymerization initiator.

In the present invention, in order to provide a further improved toner transferability, the toner particles may preferably have a shape factor SF-1 of 100–150, more preferably 100–125, further preferably 100–110, and a shape factor SF-2 of 100–140, more preferably 100–130, further preferably 100–125. As the shape factors SF-1 and SF-2 approach 100, the externally additive added to the toner particles is liable to be embedded at the toner particle surfaces, thus reducing its addition effect. However, by adding hydrophobized silicon compound fine powder having a specific particle size distribution as in the present invention, it becomes possible to effectively suppress the deterioration of additives, such as a flowability improver, externally added to the toner particles.

The shape factors SF-1 and SF-2 may be determined as follows.

Figure 8A:
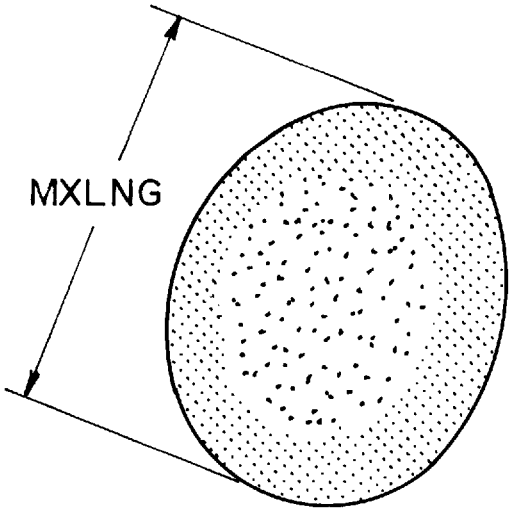
FIGS. 8A and 8B are illustrations of shape factors SF-1 and SF-2 of a toner.
Figure 8B:
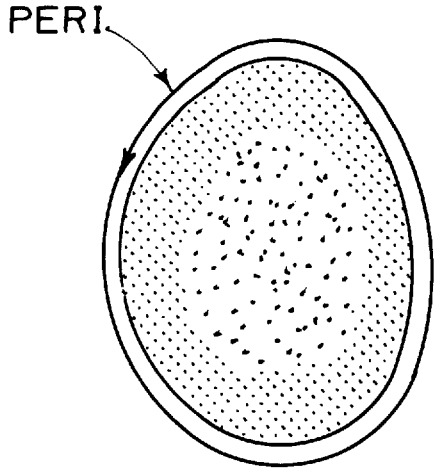

100 toner images observed through a field-emission scanning electron microscope (FE-SEM) (e.g., "S-800", available from Hitachi Ltd.) at a magnification of 500 are chosen and sampled at random. The resultant image data of the toner images are inputted into an image analyzer (e.g., "Luzex III, available from Nireco K.K.) through an interface, whereby SF-1 and SF-2 are determined based on the following equations:

$$\text{SF-1}=[(\text{MXLNG})^2/\text{AREA}]\times(\pi/4)\times 100,$$

$$\text{SF-2}=[(\text{PERI})^2/\text{AREA}]\times(1/4\pi)\times 100,$$

wherein MXLNG denotes the maximum diameter of a toner particle, AREA denotes the projection area of a toner particle, and PERI denotes a perimeter (i.e., a peripheral length of the outer surface) of a toner particle, for example, as shown in FIGS. 8A and 8B.

The shape factor SF-1 represents a degree of deviation from a sphere as shown in FIG. 8A, and the shape factor SF-2 represents a degree of unevenness, respectively of toner particles.

Toner particles produced by a method comprising the steps of melt-kneading and pulverization (so-called, "pulverization method") have an irregular shape and generally have an SF-1 above 150 and an SF-2 above 140. In the case of using a full-color copying machine wherein plural toner images are developed and transferred, an amount of toner particles placed on a photosensitive member is increased when compared with that in the case of a monochrome (white-black) copying machine only using a black toner. As a result, it is difficult to improve transfer efficiency of toner particles by only using conventional toner particles having an irregular shape. In addition, if such toner particles having an irregular shape are used in the full-color copying machine, sticking or filming of the toner particles is liable to occur on the surface of a photosensitive member or the surface of an intermediate transfer member due to shearing force or frictional force between plural members, such as the photosensitive member and a cleaning member, the intermediate transfer member and the cleaning member, and the photosensitive member and the intermediate transfer member. Thus, in the case of forming a full-color toner image, it is difficult to uniformly transfer the toner image. Further, if an intermediate transfer member is used therefor, some problems in respects of color unevenness and color balance are liable to occur, so that it is not easy to stably output high-quality full-color images.

In case where toner particles have an SF-1 in excess of 150, the shape of the toner particles differs from a sphere and is closer to an irregular shape, thus causing a lowering in transfer efficiency of a toner image at the time of a transfer form an electrostatic image-bearing member to an intermediate transfer member. As a result, a lowering in transfer efficiency of the toner image at the time of a transfer from the intermediate transfer member to a transfer-receiving material is also confirmed. In order to improve the transfer efficiencies of the toner image, toner particles my more preferably have an SF-1 of 100–140, further preferably 100–130.

In case where toner particles have an SF-2 in excess of 140, the surface of the toner particles is not smooth but is uneven, so that the above-mentioned two transfer efficiencies (i.e., from the electrostatic image-bearing member to intermediate transfer member and from the intermediate transfer member to the transfer-receiving material) are liable to be lowered. In order to improve such transfer efficiencies of the toner image, toner particles may preferably have an SF-2 of 100–140, more preferably 100–130, further preferably 100–125.

As described above, the toner particles may preferably have a high sphericity (i.e., closer to an SF-1 of 100) and also an even surface shape or a decreased degree of surface unevenness (i.e., closer to an SF-2 of 100) in order to further improve the above-mentioned transfer efficiencies. Accordingly, the toner particles may preferably have an SF-1-of 100–125 and an SF-2 of 100–130, particularly an SF-1 of 100–110 and an SF-2 of 100–125.

The transfer efficiency may be evaluated by measuring transfer ratios a follows.

A transfer ratio A (%) to an intermediate transfer member may be measured as follows. A toner image (image density of ca. 1.5) is formed on an electrostatic image-bearing member and sampled by a transparent adhesive type and the image density thereof ($d_1$) is measured by a Macbeth densitometer or a color reflection densitometer (e.g., a color reflection densitometer "X-RITE 404A", mfd. by X-Rite Co.). Next, an identical toner image is formed on the electrostatic image-bearing member and transferred to an intermediate transfer member, and the transferred toner image is sampled by an identical transparent adhesive type to measure the image density thereof ($d_2$).

From the result, a transfer ratio A (%) from the electrostatic image-bearing member to the intermediate transfer member is calculated as follows:

A (%)=[(Image density of a toner image sampled from an intermediate transfer member ($d_2$))/(image density of a toner image sampled from an electrostatic image-bearing member ($d_1$)]×100.

Similarly, a toner image is further transferred from the intermediate transfer member to a transfer-receiving material (recording sheet) and the transferred image is again sampled by a transparent adhesive tape to measure image density thereof ($d_3$).

Then, a transfer ratio B (%) is calculated as follows:

B (%)=[(image density of a toner image sampled from a transfer-receiving material ($d_3$))/(image density of a toner image sample from an intermediate transfer member ($d_2$))] ×100.

Then, an overall transfer ratio C (%) is calculated as follows:

$$C\ (\%)=A\ (\%)\times B\ (\%)/100.$$

By toner production according to the pulverization process, it is difficult to obtain toner particles having a shape factor SF-1 in the range of 100–150. A toner prepared by the melt-spraying process may have an SF-1 in such a prescribed range but is liable to have a broad particle size distribution. A toner prepared by the dispersion polymerization process shows a very sharp particle size distribution, but the process allows only a narrow range for selection of materials used and the organic solvent used is liable to provide difficulties in disposal of waste solvent and in flammability of the solvent, thus requiring a complicated apparatus and troublesome operation. The emulsion polymerization process as represented by the soap-free polymerization process is effective in a relatively uniform toner particle size, but the emulsifier and polymerization initiator terminal are allowed to remain on the toner particle surfaces to be liable to provide inferior environmental characteristic in some cases.

In the present invention, it is particularly preferred to produce toner particles through the suspension polymerization process under a normal or elevated pressure whereby fine toner particles having a size of 4–8 $\mu$m and a sharp particle size distribution can be produced relatively easily so as to have an SF-1 controlled within the range of 100–150. It is also preferred to adopt a seed polymerization process wherein a monomer is adsorped onto once-obtained polymerizate particles and polymerized in the presence of a polymerization initiator.

A further preferred-type of toner particles used in the present invention may have a shape factor SF-1 of 100–150, preferably 100–140, further preferably 100–130, contain 5–40 wt. parts of a release agent per 100 wt. parts of the binder resin, and have a core-shell structure wherein the release agent is enclosed within an outer shell of the binder resin as confirmed by observation of a section of each toner particle through a transmission electron microscope (TEM). A toner having such a structure may be directly produced through the suspension polymerization process.

In the case of incorporating a large amount of a release agent in a toner particle so as to provide a good fixability, it essentially becomes necessary to enclose or encapsulate the release agent within an outer shell of resin. Unless such a enclosure is performed, the toner particles cannot be sufficiently pulverized without resorting to special freepulverization process, and the resultant toner particles are caused to have a broad particle size distribution and are liable to cause melt-sticking onto the apparatus wall. Such freeze-pulverization requires a complicated apparatus for avoiding moisture condensation onto the apparatus and, in case of moisture absorption by the toner particles, an additional drying step may be required. Such an enclosed structure of the release agent in the toner particles may be obtained through a process wherein the release agent is selected to have a polarity in an aqueous medium which polarity is lower than that of a principal monomer component and a small amount of a resin or monomer having a larger polarity is added thereto, to provide toner particles having a core-shell structure. The toner particle size and its distribution may be controlled by changing the species and amount of a hardly water-soluble inorganic salt or a dispersant functioning as a protective colloid; by controlling mechanical apparatus conditions, such as a rotor peripheral speed, a number of pass, and stirring conditions inclusive of the shape of a stirring blade; and/or by controlling the shape of a vessel and a solid content in the aqueous medium.

Figure 9:
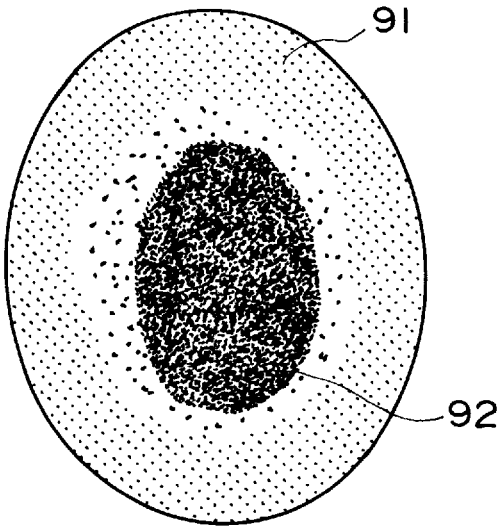
FIG. 9 is a sectional view of a toner particle enclosing a release agent.

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the low-softening point compound and the outer resin by utilizing a difference in crystallinity therebetween. A typical preferred cross-section of toner particles is shown in FIG. 9, wherein the release agent 92 is enclosed within the outer shell resin 91.

In order to enclose the release agent in the toner particles, it is particularly preferred to add a polar resin in the monomer composition. Preferred examples of such a polar resin may include styrene-(meth)acrylate copolymer, maleic acid-based copolymer, saturated polyester resin and epoxy resin. The polar resin may particularly preferably have no unsaturated group capable of reacting with the outer resin or a vinyl monomer constituting the outer resin. This is because if the polar resin has an unsaturated group, the unsaturated group can cause crosslinking reaction with the vinyl monomer, thus resulting in an outer resin having a very high molecular weight, which is disadvantageous because of a poor color-mixing characteristic.

Examples of the polymerization initiator usable in the direct polymerization may include: azo- or diazo-type polymerization initiators, such as 2,2'-azobis-(2,4-dimethylvaleronitrile), 2,2'-azobisisobutylonitrile, 1,1'-azobis-(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while making reference to 10-hour half-life period temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may alsopol produced by direct polymerization in the following manner. Into a polymerizable monomer, a release agent comprising the low-softening point compound, a colorant, a charge control agent, a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a later stage of the polymerization. It is also possible to subject a part of the aqueous system to distillation in a later stage of or after the polymerization in order to remove the yet-polymerized part of the polymerizable monomer and a by-product which can cause an odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In the case of producing toner particles through the melt-kneading-pulverization-classification process, it is preferred to add a step of treating the toner particles thermally or by application of a mechanical impact force to provide shape factors SF-1 and SF-2 closer to 100.

The above-mentioned release agent may preferably have a solubility parameter (SP value) in the range of 7.5–9.7. A release agent having an SP value of below 7.5 shows a poor compatibility with the binder resin, thus failing to provide a good dispersion within the binder resin. As a result, the resultant toner is liable to cause melt-sticking of the release agent onto a developing sleeve during continuous image formation on a large number of sheets, a change in toner charge, ground fog and a density charge at the time of toner replenishment. In the case of using a release agent having an SP value exceeding 9.7, the toner particles are liable cause blocking among the particles. Further, because of too good a mutual solubility, it becomes difficult to form a sufficient toner layer between the fixing member and a fixed toner image, thereby being liable to cause offset phenomenon. The SP values may be derived by the Fedors' method (Polym. Eng. Sci., 14 (2) 147 (1974)) by using the additivity of the atomic groups constituting the release agent.

The release agent may preferably have a melt viscosity at 130° C. of 1–300 cPs, more preferably 3–50 cPs, as measured by a viscometer ("VP-500", mfd. by HAAKE Co.) using a cone-plate-type rotor (PK-1). If the melt viscosity is below 1 cPs, when the resultant toner as a mono-component developer is applied to form a thin coating layer on a developing sleeve by means of a blade, etc., the toner is liable to cause sleeve staining due to a mechanical shearing force. Also in the case of a two-component type developer, the toner is liable to be damaged by a shearing force with the carrier and cause embedding of the external additive and breakage of the toner particles. In case of a melt viscosity exceeding 300 cPs, because of too high a monomer composition of the monomer composition, it becomes difficult to obtain minute toner particles of a uniformly small particle size, thus being liable to provide toner particles having a broad particle size distribution.

The release agent may preferably have a Vickers hardness in the range of 0.3–5.0, further preferably 0.5–3.0.

The Vickers hardness of a release agent may be measured by using a dynamic ultra-micro hardness meter ("DUH-200", available from Shimazu Seisakusho K.K.) and a Vickers indenter under a load of 0.5 g and a loading speed of 9.67 mg/sec to cause a displacement of 10 $\mu$m and holding thereat for 15 sec. Then, the resultant indentation is analyzed to measure a Vickers hardness. A sample pellet is prepared by melt-casting a sample release agent into a mold of 20 mm-diameter to a thickness of 5 mm.

Toner particles containing a release agent having a Vickers hardness below 0.3 are liable to be broken at a cleaning section in an electrophotographic apparatus in image formation on a large number of sheet, thus causing melt sticking onto the photosensitive member and resulting in black streaks in the resultant images. Further, when image sample sheets are stacked in layers, the fixed toner image is liable to be transferred onto the back side of the image sheets. Toner particles containing a release agent having a Vickers hardness in excess of 5.0 requires an excessively high fixing pressure at the time of hot-pressure fixation.

Now, explanation is given to hydrophobized inorganic fine powder having an average particle size of 10–90 nm and functioning as a flowability improver.

The inorganic fine powder to be hydrophobized may comprise: metal oxides, such as titanium oxide, aluminum oxide, strontium titanate, cerium oxide, and magnesium oxide; nitrides, such as silicon nitride; carbides, such as carbon nitride; metal salts, such as calcium sulfate, barium sulfate, and calcium carbonate; and fluorinated carbon. Among these, it is particularly preferred to use titanium oxide. The titanium oxide may be produced by vapor phase oxidation of titanium halides or titanium alkoxide. The titanium oxide may be crystalline (anatase-structure or rutile-structure) or amorphous.

The inorganic fine powder may be hydrophobized (i.e., hydrophobicity-imparted) by the wet process or the dry process.

Examples of the hydrophobizing agents may include: silane coupling agent, titanate coupling agent, aluminate coupling agent, zircoaluminate coupling agents and silicone oil. Silane coupling agents are particularly preferred, as represented by the formula:

$$R_m \, Si \, Y_n,$$

wherein R denotes an alkoxy group; Y denotes a hydrocarbon group, such as an alkyl group, vinyl group, glycidoxy group, and methacryl group; m denotes an integer of 1–3 and n denotes an integer of 1–3. Among the silane coupling agents, it is particularly preferred to use monoalkyltrialkoxysilane coupling agents.

Specific examples of the silane coupling agent may include: vinyltrimethoxysilane, vinyltriethoxysilane, γ-methacryloxypropyltrimethoxy-silane, vinyltriacetoxysilane, methyltrimethoxysilane, methyltriethoxysilane, ethyltrimethoxysilane, ethyltriethoxysilane, propyltrimethoxysilane, propyltriethoxysilane, butyltrimethoxysilane, butyltriethoxysilane, isobutyltrimethoxysilane, isobutyltriethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, n-octadecyltrimethoxysilane, n-butyltrimethoxysilane, and n-octyltrimethoxysilane.

It is preferred that 100 wt. parts of inorganic fine powder is treated with 1–50 wt. parts, more preferably 3–40 wt. parts of the hydrophobizing agent. If the treating amount is below 1 wt. part, only little hydrophobization effect can be obtained, thus allowing a quick charge leakage and providing a lower charge stability of the toner in a high humidity environment. If the treating amount exceeds 50 wt. parts, the hydrophobicity becomes excessive to provide an excessive toner charge in a low-humidity environment. Further, the formation of excessively large secondary particles is promoted, thus being liable to rather lower the flowability-improving effect.

The hydrophobized inorganic fine powder may be measured by taking a picture (at a magnification of $5\times10^4$) through a scanning electron microscope (e.g., one available from Hitachi Seisakusho K.K.) and the photograph is analyzed by an image analyzer ("Luzex III", available from Nireco K.K.) to measure the longer diameters of at least 100 particles having a diameter of at least 5 nm and take an arithmetic average of the measured data as an average particle size.

The hydrophobized inorganic fine powder may preferably have a hydrophobicity of 20–80%, more preferably 35–75%. The hydrophobicity may be measured by adding 0.2 g of a powder sample into 50 ml of water in an Erlenmeyer flask and titrating the dispersion by adding methanol through a buret until all the fine powder in the flask is melted therewith while continually stirring the content in the flask with a magnetic stirrer. The terminal point of the titration may be recognized by all the fine powder is suspended within the liquid. The hydrophobicity is measured as a content (percentage) of methanol in the methanol-water mixture at the terminal point of titration.

If the hydrophobicity is below 20%, the toner chargeability is liable to be lowered by long time of standing in a high-humidity environment. If the hydrophobicity exceeds 80%, the charge control of the fine powder per se becomes difficult, whereby the toner is liable to be excessively charged (charge-up) in a low-humidity environment.

The hydrophobized inorganic fine powder may preferably have a triboelectric charge(ability) of at most 45 mc/kg, more preferably at most 30 mc/kg, in terms of an absolute value when measured together with iron powder carrier, so as to provide a stable chargeability to a toner of a small particle size.

The triboelectric charge(ability) of hydrophobized inorganic fine powder may be measured similarly as the measurement of triboelectric charge(ability) of a toner described hereinafter after shaking a mixture of 2 wt. parts of hydrophobized inorganic fine powder with 98 wt. parts of iron powder carrier (e.g., "EFV-200/300" available from POWDER TECH Co. Ltd.) in a polyethylene bottle 300–400 times.

Further, the hydrophobized inorganic fine powder may preferably show a BET specific surface area of 100–300 $m^2/g$ as measured by nitrogen adsorption so as to provide an effectively increased flowability to the toner particles.

The hydrophobized inorganic fine powder may preferably be used in 0.05–3.5 wt. parts, more preferably 0.1–2.0 wt. parts, to 100 wt. parts of the toner particles. If the addition amount is below 0.05 wt. part, only a low flowability-improving effect is imparted to the toner particles. If the addition amount exceeds 3.5 wt. parts, a portion thereof isolated from the toner particles is liable to stain or contaminate the surface of the carrier or developing sleeve, thus being liable to lower the toner chargeability.

Now, explanation is made to hydrophobized silicon compound fine powder used for preventing or suppressing the above hydrophobized inorganic fine powder from being embedded at the toner particle surface.

The silicon compound fine powder as a base material to be hydrophobized may preferably comprise silica fine powder or silicone resin fine powder. The silica fine powder may assume a structure obtained by coating a core of another inorganic fine particles with silica.

Such silica fine powder may be produced by vapor-phase oxidation of silicon halide or through the sol-gel process.

The silicon compound fine powder may be hydrophobized by treating it with a hydrophobizing agent, preferred examples of which may include silane coupling agents and silicone oil. Example of the silane coupling agents may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, and 1,3-diphenyltetramethyldisiloxane.

It is also possible to treat the silicon compound fine powder with a nitrogen-containing silane coupling agent in order to provide a positive triboelectric chargeability in the hydrophobized state.

Examples thereof may include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine.

Examples of the silicone oil may include those represented by the following formula:

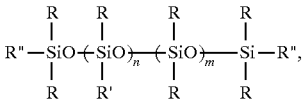

wherein R denotes a $C_{1-3}$ alkyl group; R' denotes a modifying group such as alkyl, halogenated alkyl, phenyl, or a modified phenyl; and R" denotes a $C_{1-3}$ alkyl or alkoxy group. Specific examples thereof may include: dimethylsilicone oil, alkyl-modified silicone oil, α-methylstyrene-modified silicone oil, and fluorinated silicone oil. It is preferred to use a silicone oil having a viscosity at 25° C. of 50–1000 centi-stokes.

It is also possible to treat the silicon compound fine powder with a nitrogen-containing silicone oil in order to provide both hydrophobicity and positive triboelectric chargeability. Such nitrogen-containing silicone oil may be represented as silicone oil having at least a partial structure of the following formula including a nitrogen-containing side chain:

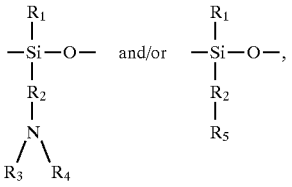

wherein $R_1$ denotes hydrogen, alkyl, aryl or alkoxy; $R_2$ denotes alkylene or phenylene; $R_3$ and $R_4$ denote hydrogen, alkyl or aryl; and $R_5$ denotes a nitrogen-containing heterocyclic group. The above-mentioned alkyl, aryl, alkylene or phenylene can comprise a nitrogen-containing organo group or have a substituent, such as halogen, within an extent of not impairing the chargeability.

The hydrophobizing agent may be used in an amount of 1–50 wt. parts, preferably 2–35 wt. parts per 100 wt. parts of the silicon compound fine powder. The resultant hydrophobicity may preferably be 30–80%, more preferably 35–75%.

The hydrophobized silicon compound fine powder may preferably be used in 0.05–3.5 wt. parts, more preferably 0.1–2.0 wt. parts, per 100 wt. parts of the toner particles.

Figure 2:
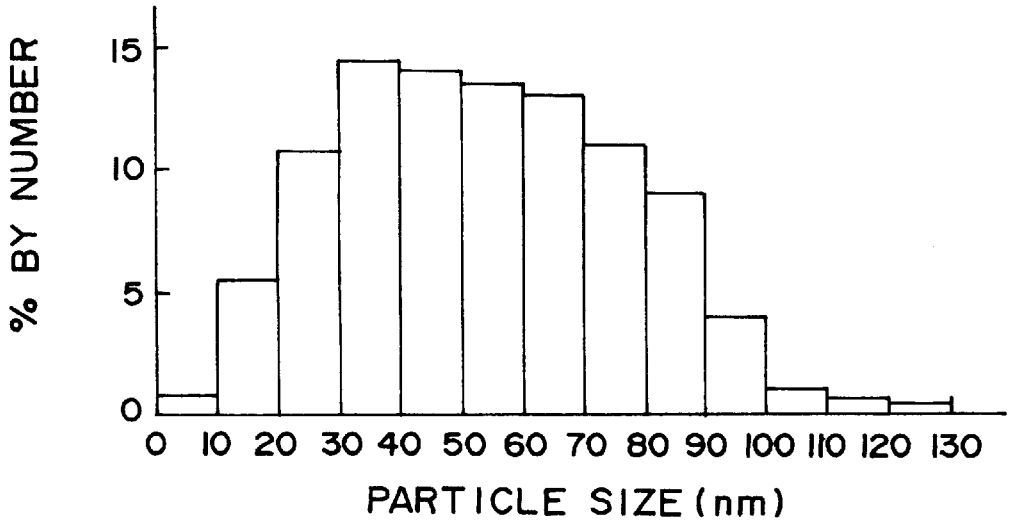
Figure 3:
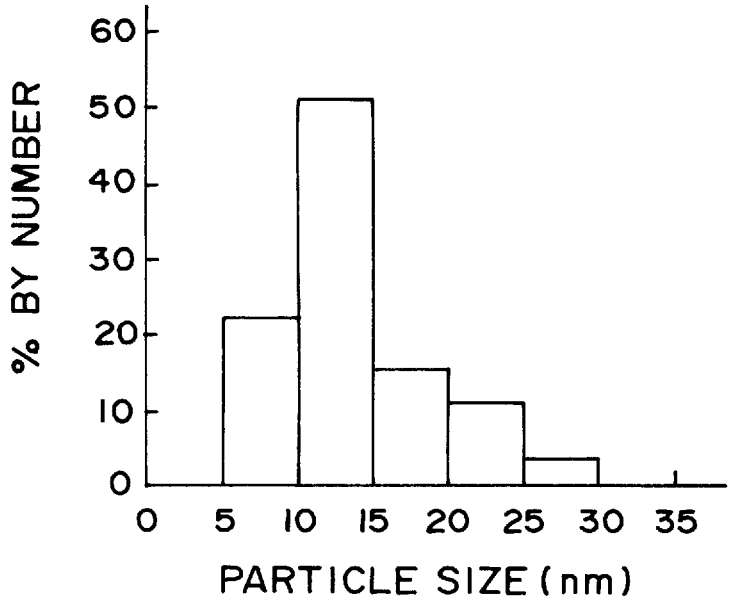
Figure 4:
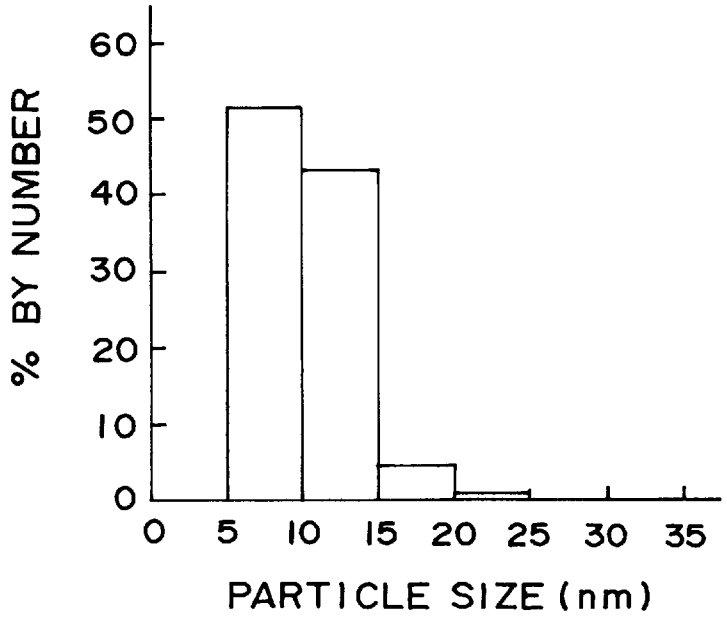

The hydrophobized silicon compound fine powder may be used to prevent or suppress the hydrophobized inorganic fine powder (added to remarkably improve the flowability of the toner particles) from being embedded at the toner particle surface and, for this purpose, may have a particle size distribution which is broader than that of the ordinary silica fine powder used as a flowability improver and includes coarse particles. As examples of the hydrophobized silicon compound fine powder, FIGS. 1 and 2 show particle size distribution of, hydrophobic silica fine particles (A) and (B), respectively, including coarse particles. On the other hand, FIGS. 3 and 4 show particle size distributions of hydrophobic silica fine powder (C) and (D), respectively, having a small average particle size and almost free from particles having sizes in excess of 30 nm, ordinarily used as a flowability improver.

The hydrophobized silicon compound fine powder used in the present invention has an average particle size of 30–120 nm and a broad particle size distribution such that it contains 15–45% by number, preferably 20–40% by number, of particles having sizes of 5–30 nm; 30–70% by number, preferably 45–70% by number, more preferably 50–70% by number, of particles having sizes of 30–60 nm; and 5–45% by number, preferably 10–40% by number, of particles having sizes of at least 60 nm.

The hydrophobic silica fine powder (A) having a particle size distribution shown in FIG. 1 has an average particle size of 40 nm, a BET specific surface area of 60 $m^2/g$ as measured by nitrogen gas adsorption, a hydrophobicity of 68%, a triboelectric charge of −170 mC/kg and a particle size distribution including 28% by number of particles having sizes of 5–30 nm, 60.5% by number of particles having sizes of 30–60 nm, and 11.5% by number of particles having sizes of at least 60 nm.

The hydrophobic silica fine powder (B) having a particle size distribution shown in FIG. 2 has an average particle size of 53 nm, a BET specific surface area of 50 $m^2/g$ as measured by nitrogen gas adsorption, a hydrophobicity of 65%, a triboelectric charge of −160 mC/kg and a particle size distribution including 19% by number of particles having sizes of 5–30 nm, 42% by number of particles having sizes of 30–60 nm, and 39% by number of particles having sizes of at least 60 nm.

The hydrophobized silicon compound fine powder, such as the hydrophobic silica fine powder (A) and (B), has a function of effectively preventing the flowability improver from being embedded at the toner particle surface, increasing the transfer efficiency of a toner image at the transfer step and promoting the removal of residual toner particles of a small particle size from an electrostatic image-bearing member in the cleaning step. The above-mentioned effects may be attributable to the coarse particle fraction having a relatively large particle size contained in the silicon compound fine powder, which coarse particles are assumed to be less liable to be embedded at the toner particle surfaces and function as a spacer preventing the embedding of the flowability improver at the toner particle surfaces. Further, in case where the silicon compound fine powder has a larger absolute value of triboelectric charge than the flowability improver, it is assumed to be more closely present to the toner particles than the flowability improver, thereby further effectively preventing the embedding of the flowability improver at the toner particle surfaces.

In contrast thereto, the hydrophobic silica fine powder (C) shown in FIG. 3 has an average particle size of 16 nm, a BET specific surface area of 130 $m^2/g$, a hydrophobicity of 28%, a triboelectric charge of −200 mc/kg, and contains 100% by number of particles having sizes of 5–30 nm.

Further, the hydrophobic silica fine powder (D) shown in FIG. 4 has an average particle size of 12 nm, a BET specific surface area of 200 $m^2/g$, a hydrophobicity of 23%, a triboelectric charge of −210 mc/kg, and contains 100% by number of particles having sizes of 5–30 nm.

The hydrophobic silica fine powder (C) and (D) are ordinarily used as a flowability improver and are characterized by having a sharp particle size distribution free from coarse particles. Such hydrophobic silica fine powder (C) or (D), even if added to toner particles, shows only a very small effect of preventing the embedding of the hydrophobized inorganic fine powder at the toner particle surfaces.

In order to more effectively show the effect of preventing the embedding of the hydrophobized inorganic fine powder, the hydrophobized silicon compound fine powder may preferably show a BET specific surface area by nitrogen gas adsorption of at most 80 $m^2/g$, more preferably at most 70 $m^2/g$, and an absolute value of triboelectric chargeability with respect to iron powder carrier of 50–300 mc/kg, preferably 70–250 mc/kg.

The effect of co-addition of the hydrophobized inorganic fine powder and the hydrophobized silicon compound fine powder may be more pronounced as the shape factors SF-1 and SF-2 of the toner particles approach 100.

The toner according to the present invention may ordinarily be used as a one-component type developer or a two-component type developer. As a one-component type developer, magnetic toner comprising toner particles containing a magnetic material may be conveyed and charged by utilizing a developing sleeve containing a magnet. A non-magnetic toner containing no magnetic material may be triboelectrically charged by forced application thereof onto a developing sleeve by means of a blade or a roller and conveyed by attachment on the sleeve.

For a two-component type developer, the toner according to the present invention may be used together with a carrier. A magnetic carrier may comprise an element, such as iron, copper, zinc, nickel, cobalt, manganese or chromium alone or in a complex ferrite state. The shape of the magnetic carrier may be spherical or flat or irregular. It is preferred to control the surface micro-structure (e.g., surface unevenness) of the magnetic carrier particles. Generally, an oxide of the above-described element(s) may be calcined and formed into particles to prepare magnetic carrier core particles, which may be further coated with a resin. For the purpose of reducing the load of the magnetic carrier on the toner, it is possible to prepare a low-density dispersion-type carrier by melt-kneading of an inorganic oxide and a resin followed by pulverization and classification or prepare a true-spherical magnetic carrier by direct suspension polymerization of a kneaded mixture of an inorganic oxide and a monomer in an aqueous medium.

Coated carriers obtained by coating the above-mentioned carrier material with a resin, are particularly preferred. Various known coating methods may be adopted, inclusive of application of a solution or suspension liquid of a resin in a solvent, and blending of powdery resin and carrier particles.

Examples of the solid carrier-coating material may include: polytetrafluoroethylene, monochlorotrifluoroethylene, polyvinylidene fluoride, silicone resin, polyester resin, styrene resin, acrylic resin, polyamide, polyvinyl butyral, and amino-acrylate resin. These coating materials may be used singly or in mixture of two or more species.

The carrier may preferably have magnetic properties as follows. It is preferred to have a magnetization at 1000 oersted after magnetic saturation ($\sigma 1000$) of 30–300 emu/$cm^3$, more preferably 100–250 emu/$cm^3$, so as to accomplish high image qualities. Above 300 emu/$cm^3$, it becomes difficult to obtain high-quality toner images. Below 30 emu/$cm^3$, carrier attachment is liable to occur because of a small magnetic constraint force.

The carrier particles may preferably have a shape factor SF-1 (representing a remoteness from a sphere) of at most 180, and a shape factor SF-2 (representing a degree of unevenness) of at most 250. The shape factors SF-1 and SF-2 of carrier particles may be measured similarly as those of the toner particles described above by observation of 100 particles taken at random through a scanning electron microscope and image analysis by an image analyzer (e.g., "Luzex III", available from Nireco K.K.). Similar calculation formula may be given as follows:

$$\text{SF-1}=[(\text{carrier maximum length})^2/\text{area}]\times(\pi/4)\times 100$$

$$\text{SF-2}=[(\text{carrier peripheral length})^2/\text{area}]\times(1/4\pi)\times 100$$

In the case of preparing a two-component type developer by blending the toner according to the present invention with a magnetic carrier, it is preferred to adopt a mixing ratio giving a toner concentration in the developer of 2–15 wt. %, more preferably 4–13 wt. %.

Image forming methods to which the toner according to the present invention is applicable will be described with reference to the drawings.

Figure 5:
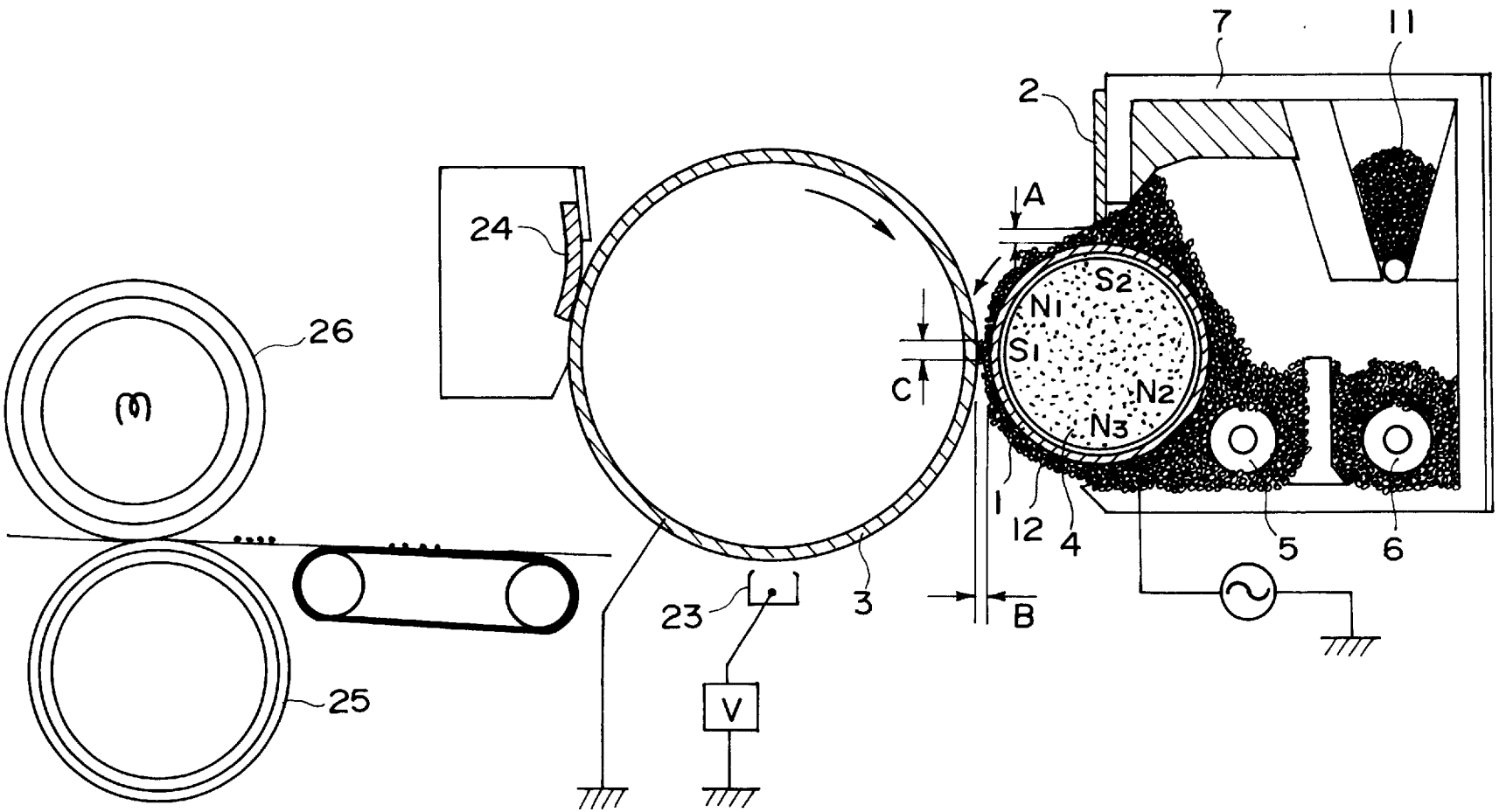
FIG. 5 is a schematic illustration of an example of an image forming apparatus to which a two-component type developer for magnetic brush development prepared by mixing a toner according to the invention and a magnetic carrier is suitably applied.

The toner according to the present invention blended with a magnetic carrier may for example be used for development by using a developing means as shown in FIG. 5. It is preferred to effect a development in a state where a magnetic brush contacts a latent image-bearing member, e.g., a photosensitive drum 3 under application of an alternating electric field. A developer-carrying member (developing sleeve) 1 may preferably be disposed to provide a gap B of 100–1000 $\mu$m from the photosensitive drum 3 in order to prevent the toner attachment and improve the dot reproducibility. If the gap is narrower than 100 $\mu$m, the supply of the developer is liable to be insufficient to result in a low image density. In excess of 1000 $\mu$m, the lines of magnetic force exerted by a developing pole S1 is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 1 with the photosensitive drum 3 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 2 and the developing sleeve 1 and/or changing the gap B between the developing sleeve 1 and the photosensitive drum 3.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image. The use of the toner according to the present invention is also effective in realizing a high transfer ratio in a subsequent transfer step. As a result, it becomes possible to high image qualities both at the halftone portion and the solid image portion.

In addition to the high image quality at an initial stage of image formation, the use of the toner according to the present invention is also effective in avoiding the lowering in image quality in a continuous image formation on a large number of sheets.

The toner image formed on the electrostatic image-bearing member is transferred onto a transfer-receiving material (such as plain paper) by a transfer means, such as a corona discharger 23. Then, the toner is fixed onto the transfer-receiving material by a hot-pressure fixing means including a heating roller 26 and a pressure roller 25. The transfer residual toner remaining on the electrostatic image-bearing member 3 is removed from the electrostatic image-bearing member by a cleaning means such as a cleaning blade 24. The toner according to the present invention shows a high transfer efficiency in the transfer step to have little transfer residual toner and also shows a good cleanability, thereby being less liable to cause filming on the electrostatic image-bearing member. Further, even in a continuous image formation on a large number of sheets, the toner according to the present invention is less liable to cause embedding of the external additive to the toner particle surfaces, so that good image qualities can be retained for a long period.

In order to provide good full color images, it is preferred to use four developing devices for magenta, cyan, yellow and black, respectively, and finally effect the black development.

An image forming apparatus suitable for practicing full-color image forming method will be described with reference to FIG. 6.

Figure 6:
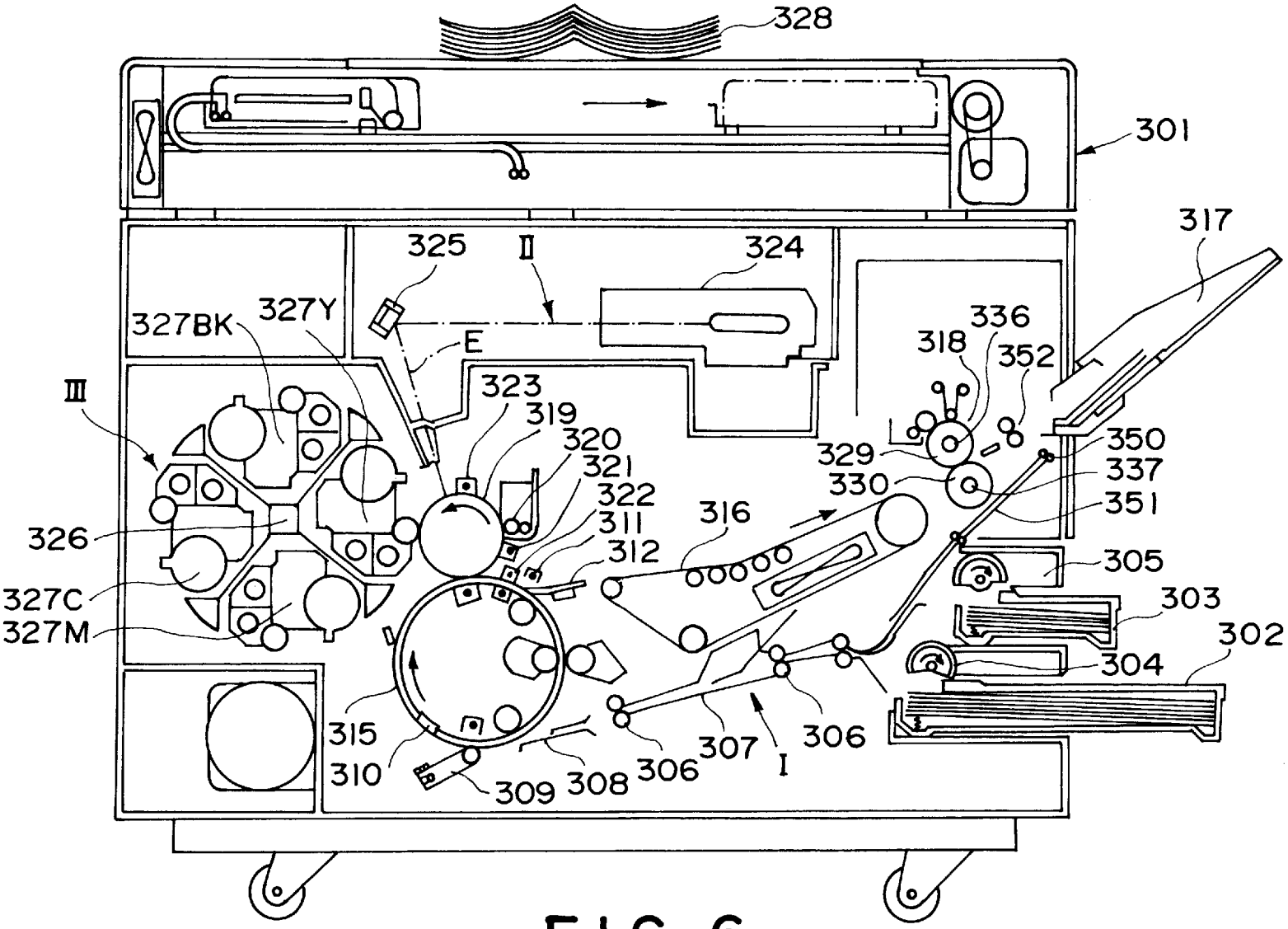
FIG. 6 is a schematic illustration of a full-color copying machine.

The color electrophotographic apparatus shown in FIG. 6 is roughly divided into a transfer material (recording sheet)-conveying section I including a transfer drum 315 and extending from the right side (the right side of FIG. 3) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly, an opening is formed through which are detachably disposed transfer material supply trays 302 and 303 so as to protrude a part thereof out of the assembly. Paper (transfer material) -supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a gripper 310, a transfer material separation charger 311 and a separation claw 312 are disposed in this order from the upperstream to the downstream alone the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 6, the moving peripheral speeds (hereinafter called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the gripper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 6).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by image-wise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the gripper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Another image forming method will be described in detail while referring to FIG. 7.

Figure 7:
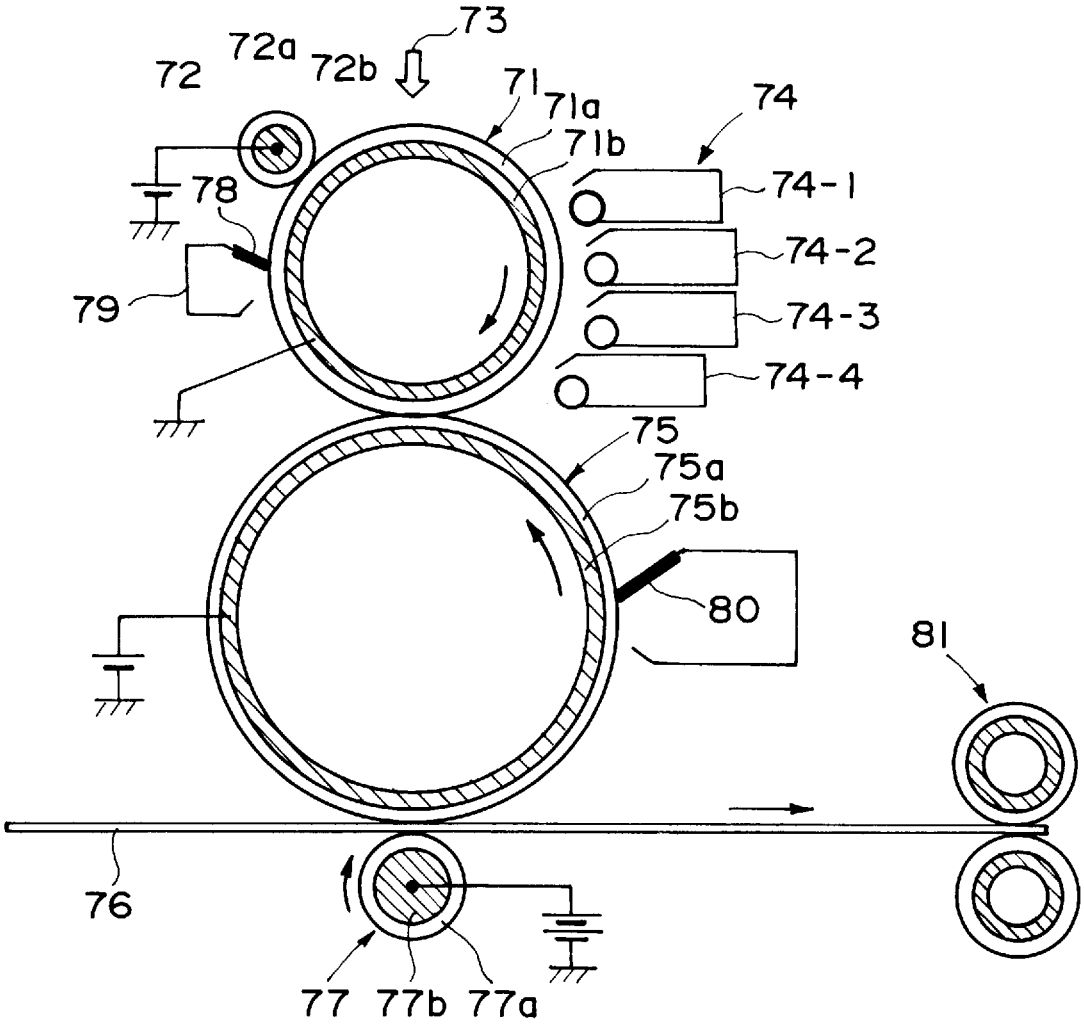
FIG. 7 is a schematic illustration of an image forming apparatus including an intermediate transfer member.

Referring to FIG. 7, an image forming apparatus principally includes a photosensitive member 71 as an electrostatic image-bearing member, a charging roller 72 as a charging means, a developing device 74 comprising four developing units 74-1, 74-2, 74-3 and 74-4, an intermediate transfer member 75, a transfer roller 77 as a transfer means, and a fixing device 81 as a fixing means.

Four developers comprising cyan toner particles, magenta toner particles, yellow toner particles, and black toner particles are incorporated in the developing units 74-1 to 74-4. An electrostatic image is formed on the photosensitive member 71 and developed with the four color toner particles by a developing method such as a magnetic brush developing system or a non-magnetic monocomponent developing system, whereby the respective toner images are formed on the photosensitive member 71. The photoconductive member 71 comprises a support 71*a* and a photosensitive layer 71*b* thereon comprising a photoconductive insulating substance such as α-Si, CdS, $ZnO_2$, OPC (organic photoconductor), and α-Si (amorphous silicon). The photosensitive member 71 may preferably comprise an α-Si photosensitive layer or OPC photosensitive layer. The photosensitive member 71 is rotated in a direction of an arrow by a drive mean (not shown).

The organic photosensitive layer may be composed of a single layer comprising a charge-generating substance and a charge-transporting substance or may be a function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin such as polycarbonate resin, polyester resin or acrylic resin because such a binder resin is effective in improving transferability and cleaning characteristic and causes little toner sticking onto the photosensitive member and filming of external additives.

A charging step may be performed by non-contact charging using a corona charger which is not in contact with the photosensitive member 71 or by contact charging using, e.g., a charging roller. The contact charging as shown in FIG. 7 may preferably be used in view of efficiently uniform charging, simplification and a lowering in amount of by-produced ozone. The charging roller 72 comprises a core metal 72*b* and an electroconductive elastic layer 72*a* surrounding a periphery of the core metal 72*b*. The charging roller 72 is pressed against the photosensitive member 71 at a prescribed pressure (pressing force) and rotated while being mated with the rotation of the photosensitive member 71.

The charging step using the charging roller may preferably performed under process conditions including an applied pressure of the roller of 5–500 g/cm, an AC voltage of 0.5–5 kVpp, an AC frequency of 50 Hz–5 kHz and a DC voltage of ±0.2–±1.5 kV in the case of applying superposed voltage of AC voltage and DC voltage; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing in occurrence of ozone. The charging roller and charging blade each used as the contact charging means may preferably comprise an electroconductive rubber and may optionally comprise a releasing film on the surface thereof. The releasing film-may preferably comprise a nylon-based resin, polyvinylindene fluoride (PVDF) or polyvinylindene chloride (PVDC).

The toner image formed on the photosensitive member is transferred to the intermediate transfer member 75 to which a voltage (e.g., ±0.1–±5 kV) is applied. The photosensitive member surface after the transfer is cleaned by a cleaning member 79 including a cleaning blade 78.

The intermediate transfer member 75 comprises a pipe-like electroconductive core metal 75*b* and a medium resistance-elastic layer 75*a* (e.g., an elastic roller) surrounding a periphery of the core metal 75*b*. The core metal 75*b* may be one comprising a plastic pipe which has been subjected to electroconductive plating. The medium resistance-elastic layer 75*a* may be a solid layer or a foamed material layer in which an electroconductivity-imparting substance such as carbon black, zinc oxide, tin oxide or silicon carbide is mixed and dispersed in an elastic material such as silicone rubber, teflon rubber, chloroprene rubber, urethane rubber or ethylene-propylene-dien terpolymer (EPDM) so as to control an electric resistance or a volume resistivity at a medium resistance level of $10^5$–$10^{11}$ ohm.cm.

The intermediate transfer member 75 is disposed under the photosensitive member 71 so that it has an axis (or a shaft) disposed in parallel with that of the photosensitive member 71 and is in contact with the photosensitive member 71. The intermediate transfer member 75 is rotated in the direction of an arrow (counterclockwise direction) at a peripheral speed identical to that of the photosensitive member 71.

The respective color toner images are successively intermediately transferred to the peripheral surface of the intermediate transfer member 75 by an electric field formed by applying a transfer bias to a transfer nip region between the photosensitive member 71 and the intermediate transfer member 75 at the time of passing through the transfer nip region.

After the intermediate transfer of the respective toner image, the surface of the intermediate transfer member 75 is cleaned, as desired, by a cleaning means 80 which can be attached to or detached from the image forming apparatus. In case where the toner image is placed on the intermediate transfer member 75, the cleaning means 80 is detached or released from the surface of the intermediate transfer member 75 so as not to damage the toner image.

The transfer means (e.g., a transfer roller) 77 is disposed under the intermediate transfer member 75 so that it has an axis (or a shaft) disposed in parallel with that of the intermediate transfer member 75 and is in contact with the intermediate transfer member 75. The transfer means (roller) 77 is rotated in the direction of an arrow (clockwise direction) at a peripheral speed identical to that of the intermediate transfer member 75. The transfer roller 77 may be disposed so that it is directly in contact with the intermediate transfer member 75 or in contact with the intermediate transfer member 75 by the medium of a belt, etc. The transfer roller 77 may be constituted by disposing an electroconductive elastic layer 77*a* on a peripheral surface of a core metal 77*b*.

The intermediate transfer member 75 and the transfer roller 77 may comprise known materials as generally used. In the present invention, by setting a volume resistivity of the elastic layer 75*a* of the intermediate transfer member 75 higher than that of the elastic layer 77*b* of the transfer, it is possible to alleviate a voltage applied to the transfer roller 77. As a result, a good toner image is formed on the transfer-receiving material and the transfer-receiving material is prevented from winding about the intermediate transfer member 75. The elastic layer 75*a* of the intermediate transfer member 75 may preferably has a volume resistivity at least ten times higher than that of the elastic layer 77*b* of the transfer roller 77.

The intermediate transfer member 75 may preferably comprise the elastic layer 75*a* having a hardness of 10–40 as measured by JIS K-6301. On the other hand, the transfer roller 77 may preferably comprise an elastic layer 77*a* having a hardness higher than that of the elastic layer. 75*a* of the intermediate transfer member 75, more preferably a hardness of 41–80 as measured by JIS K-6301 for preventing the transfer-receiving material from winding about the intermediate transfer member 75. If the hardness of the elastic layer 77*a* of the transfer roller 77 is lower than that of the elastic layer 75*a* of the intermediate transfer member 75, a concavity (or a recess) is formed on the transfer roller side, thus being liable to cause the winding of the transfer-receiving material about the intermediate transfer member 75.

The transfer roller 77 may be rotated at the same or different peripheral speed as that of the intermediate transfer member 75. The transfer-receiving material 76 is conveyed to a nip, between the intermediate transfer member 75 and the transfer roller 77, at which a toner image on the intermediate transfer member 75 is transferred to the front surface of the transfer-receiving material 76 by applying a transfer bias having a polarity opposite to that of triboelectric charge of the toner particles to the transfer roller 77.

The transfer roller 77 may comprise materials similar to those constituting the charging roller 72. The transfer step may be performed under conditions including a pressure of the transfer roller of 5–500 g/cm and a DC voltage of ±0.2–±10 kV. More specifically, the transfer roller 77 comprise a core metal 77*b* and an electroconductive elastic layer 77*a* comprising an elastic material having a volume resistivity of $10^6$–$10^{10}$ ohm.cm, such as polyurethane or ethylene-propylene-dien terpolymer (EPDM) containing an electroconductive substance, such as carbon, dispersed therein. A certain bias voltage (e.g., preferably of ±0.2–±10 kV) is applied to the core metal 77*b* by a constant-voltage supply.

The transfer-receiving material 76 is then conveyed to the fixing device 81 comprising two rollers including a heated roller enclosing a heating member (e.g., a halogen heater) and a pressure roller pressed against the heated roller at a prescribed pressure. The toner image on the transfer-receiving material 76 is passed between the heated roller and the pressure roller to fix the toner image on the transfer-receiving material 76 under application of heat and pressure. The fixing step may also be performed by applying heat to the toner image by the medium of a film by a heater.

Hereinbelow, some explanation is given to the procedure of evaluation of the respective items including fixability, anti-offset characteristic, anti-blocking characteristic, cleanability, triboelectric charge(ability) in three environments, image density change and image quality deterioration referred to in describing Examples and Comparative Examples appearing hereinafter.

1) Fixability, Anti-offset characteristic

A yet-unfixed toner image is prepared by a commercially available copying machine.

In case of a black toner, the fixability and anti-offset characteristic thereof are evaluated by an external hot roller fixing device not equipped with an oil application mechanism.

Further, a mono-color toner or full-color toners are evaluated by using an external hot roller fixing device equipped with no oil application mechanism or by using a fixing device for a commercially available digital full-color copying machine ("CLC-500", available from Canon K.K.) while applying a slight amount of oil (e.g., 0.02 g/A4 size) uniformly onto the fixing roller to evaluate the fixability, anti-offset characteristic and color-mixing region and also obtain fixed images for evaluation of the clarity.

Both rollers used at this time are those surfaced with a fluorine-containing resin or rubber.

The external hot roller fixing device including an upper roller and a lower roller respectively of a diameter of ca. 60 mm and fixing is performed at a nip of 6.5 mm, a process speed of 105 mm/sec and controlled temperatures differing by an increment of 5° C. each in the range of 80° C. to 230° C., e.g., in case where a transfer-receiving material is plain paper ("SK paper", available from Nippon Seishi K.K.).

In case where the transfer-receiving material is an OHP sheet ("CG 3300", available from 3M Co.), fixing is performed at a nip of 6.5 mm, a process speed of 25 mm/sec and a temperature of 150° C.

The fixability is measured evaluated by rubbing fixed toner images at various fixing temperatures 10 times each with a lens cleaning paper ("dasper", available from Ozu Paper Co., Ltd.) under a load of 50 g/cm$^2$. A temperature giving an image density decrease after rubbing of at most 10% is defined as a fixing initiation temperature $T_{FI}$.

The anti-offset characteristic is evaluated by observing whether the offsetting occurs or not to determine a low temperature-offset initiation temperature $T_{OL}$ by a minimum temperature at which no offset is observed at a low temperature side and a high-temperature offset termination temperature $T_{OH}$ by a maximum temperature at which no offset is observed at a high temperature side.

The color mixing (temperature) region is determined as a fixing temperature region within a non-offset region where fixed images show a gloss of at least 7 to a maximum value as measured by a handy gloss meter ("Gloss Checker IG-310", available from Horiba Seisakusho K.K.).

2) Anti-blocking characteristic 5 g each of sample toners are weighed into 50-cc cups of polyethylene and leftstanding in a drying chamber held at 40°, 50° and 50° C., respectively for 2 days. Each sample is observed as to whether it has caused agglomeration or not. The evaluation is given by a symbol "o" if the agglomeration has not occurred, and "x" if yes.

3) Cleanability, Image quality

A prescribed amount of external additive is added to sample toner particles to prepare a toner and then a developer. Then, the developer is subjected to a continuous image formation on $5\times10^4$ sheets by a commercially available full-color copying machine ("CLC-500", available from Canon K.K.) in a normal temperature/normal humidity (NT/NH) environment of 22° C./60%, whereby the cleanability and image quality are evaluated with eyes.

The cleanability is evaluated by the number of copied sheets at which cleaning failure has occurred even in a slight degree. The image quality is evaluated by the number of sheets at which a white dropout or a smaller toner coverage part has occurred in a solid fixed image part even in a slight degree.

4) Triboelectric charge in three environments

A sample (toner or external additive) and a carrier are leftstanding overnight in each of the following three environments.

high-temperature/high humidity (HT/HH) of 30° C./80%;

normal-temperature/normal humidity (NT/NH) of 22° C./65%;

low-temperature/low humidity (LT/LH) of 15° C./10%.

Thereafter, the triboelectric charge of each sample is measured in each environment by the blow-off method in the following manner.

Figure 10:
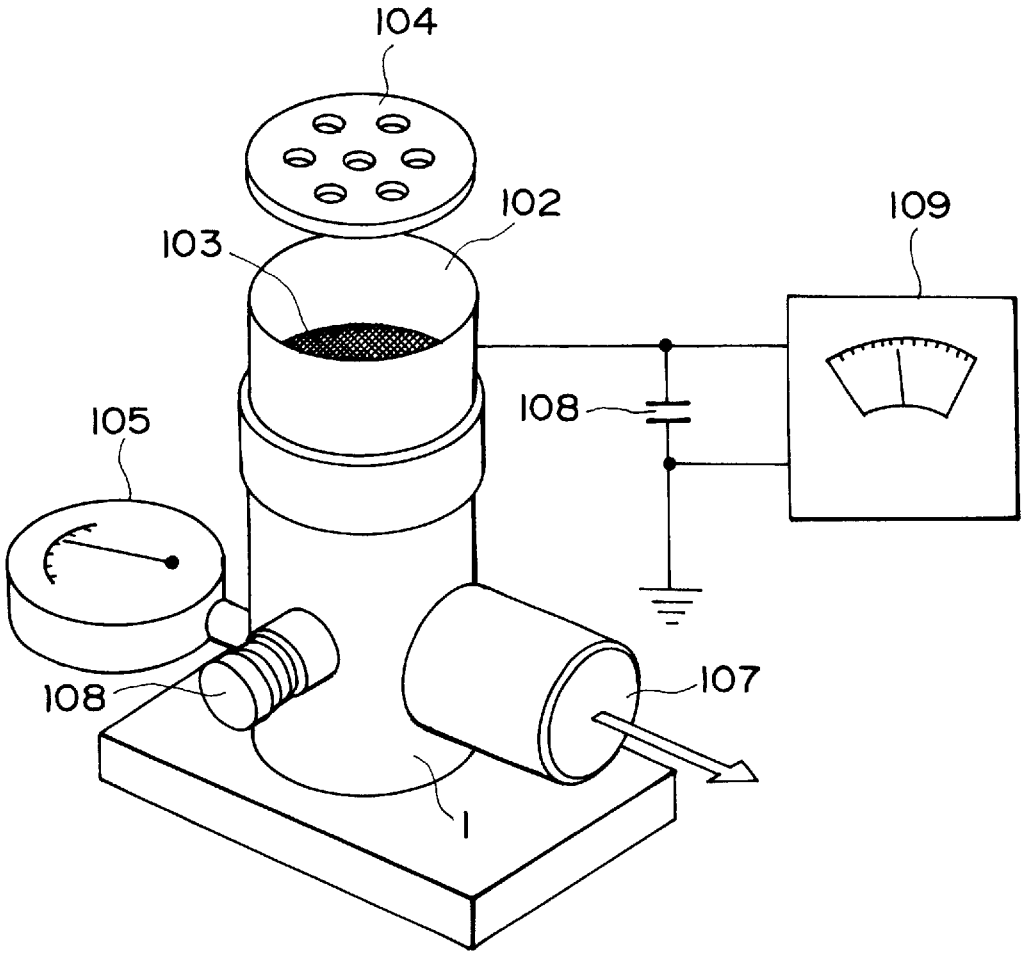
FIG. 10 is an illustration of an apparatus for measuring the triboelectric charge of a powder sample.

FIG. 10 is an illustration of an apparatus for measuring the triboelectric of a sample toner or external additive. An explanation below principally refers to the case of a toner sample.

A mixture of a sample toner and a carrier in a weight ratio of 1:19 is placed in a 50 to 100 ml-polyethylene bottle, and the bottle is shaken by hands for 5 to 10 min. Thereafter, ca. 0.5–1.5 g of the mixture (developer) is charged in a metal-made measuring container 102 equipped with a 500-mesh screen so as not to allow the passage of the carrier therethrough but selectively allow the passage of the sample, and then covered with a metal lid 104. The total weight of the container is weighed and denoted by $W_1$ (g). Then, an aspirator 101 composed of an insulating material at least with respect to a part thereof contacting the container 102 is operated to suck the sample through a suction port 107 to set a pressure at a vacuum gauge 105 at 250 mmAq while. adjusting an aspiration control valve 106. In this state, the aspiration is performed sufficiently (preferably for ca. 2 min.) to remove the sample (toner) through the screen 103. The reading at this time of a potential meter 109 connected to the container 102 via a capacitor 108 having a capacitance C ($\mu$F) is measured and denoted by V (volts). The total weight of the container after the aspiration is measured and denoted by $W_2$ (g). Then, the triboelectric charge TC (mC/kg) of the sample (toner or external additive) is calculated according to the following formula:

$$TC\ (\text{mC/kg})=(C\times V)/(W_1-W_2).$$

5) Image density

The image density (D) is measured by a Macbeth densitometer (available from Macbeth Co.) as an average of 5 measured values. The image density change before and after a continuous image formation is measured with respect to a solid image part (D=ca. 0.5).

Hereinbelow, the present invention will be described more specifically with reference to Examples and Comparative Examples.

EXAMPLE 1

Cyan toner particles were prepared in the following manner. Into a 2 liter-four necked flask equipped with a high-speed stirrer ("TK-Homomixer", available from Tokushu Kika Kogyo K.K.), 710 wt. parts of deionized water and 450 wt. parts of a 0.1 mol/liter-$Na_3PO_4$ aqueous solution was charged and warmed at 65° C. under stirring at 12,000 rpm. Into the flask, 68 wt. parts of a 1.0 mol/liter-$CaCl_2$ aqueous solution was gradually added to prepare an aqueous dispersion medium containing fine form of hardly water-soluble dispersing agent $Ca_3(PO_4)_2$. On the other hand, a monomer composition was prepared as follows:

| | |
|---|---|
| Styrene monomer | 160 wt. parts |
| n-Butyl acrylate monomer | 40 wt. parts |
| Cyan colorant (C.I. Pigment Blue 15:3) | 14 wt. parts |
| Polar resin [saturated polyester resin (terephthalic acid/propylene oxide modified bisphenol A; acid value = 15, peak molecular weight = $6\times10^3$) | 10 wt. parts |
| Negative charge control agent (dialkylsalicylic acid metal compound) | 2 wt. parts |
| Release agent (ester wax) (melting point = 59° C., Vickers hardness = 1.5) | 40 wt. parts |

The above mixture was dispersed for 3 hours by means of an attritor and then 10 wt. parts of 2,2'-azobis-(2,4-dimethylvaleronitrile) (polymerization initiator) was added thereto to formulate a monomer composition, which was then charged into the above-prepared dispersion medium, followed by particle formation for 15 min. under the retained rotation speed of 12000 rpm. Thereafter, the high-speed stirrer was replaced by propeller stirring blades, and the system temperature was raised to 80° C. to effect polymerization for 10 hours at 50 rpm. After the polymerization, the slurry was cooled and dilute hydrochloric acid was added thereto to remove the dispersing agent, followed by washing and drying to obtain insulating cyan toner particles. As a result of measurement by using a Coulter counter, the cyan toner particles showed a weight-average particle size of 6 $\mu$m, a number-basis particle size variation coefficient ($A_{VN}$) of 27%, SF-1 of 104, and SF-2 of 108. The sectional microphotograph of the toner particles was schematically as shown in FIG. 9, having a core-shell structure wherein the ester wax 92 (release agent) was encapsulated within the outer shell 91 of the binder resin (Mw=$7\times10^4$, Mn=$2\times10^4$). To 100 wt. parts of the toner particles, 1.2 wt. parts of hydrophobized inorganic fine powder (a-1) shown in Table 1 and 0.8 wt. part of hydrophobized silicon compound fine powder (A) shown in Tables 2-1 and 2-2 were added to form a cyan toner.

6 wt. parts of the cyan toner and 94 wt. parts of resin-coated magnetic ferrite carrier (Dav.=50 $\mu$m) were blended to form a two-component type developer for magnetic brush development. The developer was charged in a cyan developing device of a commercially available full-color copying machine ("CLC-500", mfd. by Canon K.K.) remodeled so that the silicone oil application rate was set to 0.02 g/A4-size and subjected to continuous image formation on $5\times10^4$ sheets of a single color-mode while replenishing the cyan toner as required. The results are shown in Table 3.

As shown in Table 3, the cyan toner (of Example 1) showed an excellent transfer ratio, allowed smooth cleaning by the cleaning blade and resulted in no filming on the OPC photosensitive member. Further, after the $5\times10^4$ sheets of the continuous image formation test, the cyan toner on the developing sleeve was sampled and observed through a scanning electron microscope as to the surface state of each toner particle, whereby the hydrophobic titanium oxide fine powder (a-1) and hydrophobic silica fine powder (A) were both found to be present on the toner particle surfaces and no deteriorated toner particles by embedding of the external additives were observed.

Comparative Example 1

Cyan toner particles prepared in the same manner as in Example 1 were blended with the hydrophobized inorganic fine powder (a-1) shown in Tables 2-1 and 2-2 hydrophobized silicon compound (C) shown in Table 2-1 an 2 to prepare a cyan toner. A two-component type developer for magnetic brush development was prepared by using the cyan toner otherwise in the same manner as in Example 1 and evaluated in the same manner as in Example 1. The results are also shown in Table 3.

As shown in Table 3, the cyan toner of Comparative Example 1 thus prepared showed an inferior transferability than that of Example 1 and caused a filming on the OPC photosensitive member. Further, as a result of the observation of the recovered cyan toner from the developing sleeve after the continuous image formation through an electron microscope, not a few toner particles showed less external additive particles present at the surfaces thereof.

Comparative Example 2

A cyan toner was prepared in the same manner as in Example 1 except for using only hydrophobized inorganic fine powder (b-1) shown in Table 1 as external additive and evaluated in the same manner as in Example 1. The evaluation results are also shown in Table 3.

Comparative Example 3

A cyan toner was prepared in the same manner as in Example 1 except for using both hydrophobized inorganic fine powder (b-1) shown in Table 1 and hydrophobized silicon compound fine powder (C) shown in Tables 2-1 and 2-2 as external additive and evaluated in the same manner as in Example 1. The evaluation results are also shown in Table 3.

Comparative Example 4

A cyan toner was prepared in the same manner as in Example 1 except for using only hydrophobized silicon compound fine powder (D) shown in Tables 2-1 and 2-2 as external additive and evaluated in the same manner as in Example 1. The evaluation results are also shown in Table 3.

Comparative Example 5

A cyan toner was prepared in the same manner as in Example 1 except for using only hydrophobized inorganic fine powder (a-1) shown in Table 1 as external additive and evaluated in the same manner as in Example 1. The evaluation results are also shown in Table 3.

Comparative Example 6

A cyan toner was prepared in the same manner as in Example 1 except for using only hydrophobized silicon compound fine powder (A) as external additive and evaluated in the same manner as in Example 1. The evaluation results are also shown in Table 3.

Comparative Example 7

A cyan toner was prepared in the same manner as in Example 1 except for using only hydrophobized silicon compound fine powder (B) as external additive and evaluated in the same manner as in Example 1. The evaluation results are also shown in Table 3.

Comparative Example 8

A cyan toner was prepared in the same manner as in Example 1 except for using only hydrophobized silicon compound fine powder (C) as external additive and evaluated in the same manner as in Example 1. The evaluation results are also shown in Table 3.

Comparative Example 9

A cyan toner was prepared in the same manner as in Example 1 except for using only hydrophobized silicon compound fine powder (D) shown in Table 1 as external additive and evaluated in the same manner as in Example 1. The evaluation results are also shown in Table 3.

Comparative Example 10

A cyan toner was prepared in the same manner as in Example 1 except for using only hydrophobized inorganic fine powder (b-2) as external additive and evaluated in the same manner as in Example 1. The evaluation results are also shown in Table 3.

Comparative Example 11

A cyan toner was prepared in the same manner as in Example 1 except for using only hydrophobized inorganic fine powder (b-3) as external additive and evaluated in the same manner as in Example 1. The evaluation results are also shown in Table 3.

Comparative Example 12

A cyan toner was prepared in the same manner as in Example 1 except for using only hydrophobized silicon compound fine powder (H) as external additive and evaluated in the same manner as in Example 1. The evaluation results are also shown in Table 3.

Comparative Example 13

A cyan toner was prepared in the same manner as in Example 1 except for using only hydrophobized silicon compound fine powder (I) as external additive and evaluated in the same manner as in Example 1. The evaluation results are also shown in Table 3.

EXAMPLE 2

A cyan toner was prepared in the same manner as in Example 1 except for using hydrophobized inorganic fine powder (a-1) and hydrophobized silicon compound fine powder (B) as external additives and evaluated in the same manner as in Example 1. The results are also shown in Table 3.

EXAMPLE 3

A cyan toner was prepared in the same manner as in Example 1 except for using hydrophobized inorganic fine powder (a-2) and hydrophobized silicon compound fine powder (E) as external additives and evaluated in the same manner as in Example 1. The results are also shown in Table 3.

EXAMPLE 4

A cyan toner was prepared in the same manner as in Example 1 except for using hydrophobized inorganic fine powder (a-3) and hydrophobized silicon compound fine powder (F) as external additives and evaluated in the same manner as in Example 1. The results are also shown in Table 3.

EXAMPLE 5

A cyan toner was prepared in the same manner as in Example 1 except for using hydrophobized inorganic fine powder (a-4) and hydrophobized silicon compound fine powder (G) as external additives and evaluated in the same manner as in Example 1. The results are also shown in Table 3.

TABLE 1

| Hydrophobized inorganic fine powder | Base material | Dav. (nm) | Hydrophobizing agent Name*1 | Hydrophobizing agent Amount*2 | Hydrophobicity (%) | T.C. (mC/kg) | $S_{BET}$ ($m^2/g$) |
|---|---|---|---|---|---|---|---|
| a-1 | titanium oxide | 51 | BTMOS | 18 | 68 | −1.5 | 105 |
| a-2 | do. | 47 | do. | 19 | 63 | −1.7 | 103 |
| a-3 | do. | 43 | IBTMOS | 21 | 59 | −2.0 | 102 |
| a-4 | alumina | 21 | do. | 17 | 66 | 1.7 | 98 |
| b-1 | titanium oxide | 49 | BTMOS | 0.5 | 5 | −1.8 | 110 |
| b-2 | do. | 44 | IBTMOS | 60 | 85 | −2.1 | 107 |
| b-3 | alumina | 28 | BTMOS | 12 | 57 | 0.8 | 97 |

*1: BTMOS = butyltrimethoxysilane
IBTMOS = isobutyltrimethoxysiline
*2Amount (wt. parts) of the hydrophobizing agent per 100 wt. parts of the base material.

| Hydrophobized silicone compound fine powder | Base *5 | Dav. (nm) | Hydrophobizing agent Name*3 | Hydrophobizing agent Amount*4 | Hydrophobicity (%) | T.C. (mC/kg) | $S_{BET}$ ($M^2/G$) | Particle size distribution (% by number) 5–30 nm | 30–60 nm | >60 nm |
|---|---|---|---|---|---|---|---|---|---|---|
| (A) | Silica | 40 | HMDS | 7 | 68 | −170 | 60 | 28 | 60.5 | 11.5 |
| (B) | Silica | 53 | HMDS | 6 | 65 | −160 | 50 | 29 | 42 | 39 |
| (C) Comp. | Silica | 16 | DMDCS | 11 | 28 | −200 | 130 | 100 | 0 | 0 |
| (D) Comp. | Silica | 12 | do. | 17 | 23 | −210 | 200 | 100 | 0 | 0 |
| (E) | Silica | 35 | do. | 13 | 58 | −165 | 65 | 45 | 50 | 5 |
| (F) | Silica | 31 | do. | 12 | 63 | −180 | 80 | 65 | 30 | 5 |
| (G) | Silica | 43 | DMDCS + S.O. | 5 | 65 | −185 | 42 | 25 | 61 | 14 |
| (H) Comp. | $SrTiO_3$ | 41 | HMDS | 6 | 59 | −175 | 70 | 24 | 30 | 46 |
| (I) Comp. | $SrTiO_3$ | 500 | do. | 3 | 52 | −165 | 50 | 0 | 1 | 99 |

*3: HMDS = hexamethyldisilazane,
DMDCS = dimethyldichlorosilane,
S.O. = silicone oil
*4:Amount (wt. parts) of the hydrophobizing agent per 100 wt. parts of the base material.
*5:$SrTiO_3$ = strontium titanate

TABLE 2-2

| Number-basis particle size distribution: particle size (nm) | Fine powder (%) (A) | (B) | (C) (Comparative) | (D) (Comparative) |
|---|---|---|---|---|
| 5.00–20.00 | 6.0 | 7.5 | 89.0 | 99.5 |
| 20.00–30.00 | 22.0 | 11.5 | 11.0 | 0.5 |
| 30.00–40.00 | 29.5 | 14.5 | 0 | 0 |
| 40.00–50.00 | 19.0 | 14.0 | 0 | 0 |
| 50.00–60.00 | 12.0 | 13.5 | 0 | 0 |
| 60.00–70.00 | 6.5 | 13.0 | 0 | 0 |
| 70.00–80.00 | 2.7 | 11.0 | 0 | 0 |
| 80.00–90.00 | 0.5 | 9.0 | 0 | 0 |
| 90.00–100.00 | 1.0 | 4.0 | 0 | 0 |
| 100.00–110.00 | 0.5 | 1.0 | 0 | 0 |
| 110.00–120.00 | 0.2 | 0.7 | 0 | 0 |
| ≧120.00 | 0.1 | 0.3 | 0 | 0 |

TABLE 3

| Example or Comp. Example | Continuous image formation test on 5 × $10^4$ sheets: Image density initial | Image density last | Transfer ratio initial (%) | Transfer ratio last (%) | Cleaning failure initial | Cleaning failure last | Embedding of additive | $T_{FI}$ (%) | Anti-offset $T_{OL}$ (°C.) | Anti-offset $T_{OH}$ (°C.) | Anti-block | T.C. (mc/kg L/L | T.C. (mc/kg N/N | T.C. (mc/kg H/H |
|---|---|---|---|---|---|---|---|---|---|---|---|---|---|---|
| Ex. | | | | | | | | | | | | | | |
| 1 | 1.51 | 1.50 | 97 | 95 | none | none | none | 130 | 125 | 220 | ○ | −30 | −28 | −27 |
| 2 | 1.51 | 1.47 | 97 | 94 | none | none | do. | 130 | 125 | 220 | ○ | −32 | −29 | −28 |
| 3 | 1.51 | 1.49 | 97 | 94 | none | none | do. | 130 | 125 | 220 | ○ | −31 | −29 | −27 |
| 4 | 1.51 | 1.48 | 97 | 93 | none | none | do. | 130 | 125 | 220 | ○ | −33 | −30 | −28 |
| 5 | 1.51 | 1.50 | 98 | 96 | none | none | do. | 130 | 125 | 220 | ○ | −34 | −31 | −26 |
| Comp. Ex. | | | | | | | | | | | | | | |
| 1 | 1.51 | 1.41 | 96 | 90 | none | 30000 | occurred | 130 | 125 | 220 | ○ | −42 | −36 | −25 |
| 2 | 1.51 | 1.39 | 96 | 87 | none | 25000 | do. | 130 | 125 | 220 | ○ | −43 | −35 | −27 |
| 3 | 1.51 | 1.35 | 96 | 85 | none | 20000 | do. | 130 | 125 | 220 | ○ | −45 | −33 | −26 |
| 4 | 1.51 | 1.37 | 96 | 86 | none | 20000 | do. | 130 | 125 | 220 | ○ | −45 | −33 | −25 |
| 5 | 1.48 | 1.24 | 94 | 75 | occurred | — | do. | 130 | 125 | 220 | ○ | −43 | −36 | −23 |
| 6 | 1.23 | 1.20 | 80 | 65 | none | 15000 | do. | 130 | 125 | 220 | ○ | −43 | −38 | −23 |
| 7 | 1.21 | 1.18 | 78 | 61 | none | 15000 | do. | 130 | 125 | 220 | ○ | −46 | −39 | −23 |
| 8 | 1.35 | 1.27 | 83 | 72 | none | 15000 | do. | 130 | 125 | 220 | ○ | −45 | −39 | −20 |
| 9 | 1.38 | 1.25 | 86 | 74 | none | 15000 | do. | 130 | 125 | 220 | ○ | −43 | −39 | −19 |
| 10 | 1.45 | 1.26 | 94 | 78 | occurred | — | do. | 130 | 125 | 220 | ○ | −47 | −34 | −20 |
| 11 | 1.45 | 1.28 | 94 | 77 | occurred | — | do. | 130 | 125 | 220 | ○ | −47 | −33 | −19 |
| 12 | 1.28 | 1.21 | 73 | 63 | none | 7000 | do. | 130 | 125 | 220 | ○ | −46 | −38 | −18 |
| 13 | 1.26 | 1.18 | 76 | 55 | none | 5000 | do. | 130 | 125 | 220 | ○ | −45 | −39 | −15 |

EXAMPLE 6

A toner was prepared and formulated into a two-component type developer, which was then used for image formation in the same image forming apparatus as in Example 1.

| | |
|---|---|
| Styrene-n-butyl acrylate copolymer (Mw = 7 × $10^4$, Mn = 2 × $10^4$) | 200 wt. parts |
| Cyan colorant (C.I. Pigment Blue 15:3) | 14 wt. parts |
| Polar resin [saturated polyester resin (terephthalic acid/propylene oxide modified bisphenol A; acid value = 15, peak molecular weight = 6 × $10^3$)] | 10 wt. parts |
| Negative charge control agent (dialkylsalicylic acid metal compound) | 2 wt. parts |
| Release agent (ester wax, m.p. = 59° C., Vickers hardness = 1.5) | 10 wt. parts |

The above ingredients were sufficiently melt-kneaded through an extruder and then pulverized by impingement using a jet stream, followed by pneumatic classification utilizing the Coanda effect to obtain irregular-shaped cyan toner particles having a weight-average particle size (Dw) of 8.5 μm, a number-basis variation coefficient ($A_{VN}$) of 37%, SF-1=152, and SF-2=145.

The resultant cyan toner particles were blended with hydrophobized inorganic fine powder (a-1) and hydrophobized silicon compound fine powder (A) to prepare a cyan toner similarly as in Example 1, and the cyan toner was evaluated in the same manner as in Example 1. The evaluation results are shown in Table 5.

EXAMPLE 7

Cyan toner particles prepared in the same manner as in Example 6 were blended with commercially available calcium phosphate fine powder by a Henschel mixer, and the resultant powder mixture was charged into water in a vessel and dispersed in the water by a homomixer, followed by gradual heating to 80° C. and heating at the temperature for 3 hours. Then, dilute acid was added to the system to sufficiently dissolve the calcium phosphate on the cyan toner particle surfaces. The cyan toner particles were then recovered by filtration, washed, dried and sieved through a 400-mesh to remove the agglomerate, thereby recovering spherical cyan toner particles, which showed SF-1=109, SF-2=120 and was found to be electrically insulating. The toner particles showed a weight-average particle size (Dw) of 7.7 μm and a number-basis particle size variation coefficient ($A_{VN}$) of 28%.

The resultant cyan toner particles were blended with hydrophobized inorganic fine powder (a-1) and hydrophobized silicon compound fine powder (A) to prepare a cyan toner similarly as in Example 1, and the cyan toner was evaluated in the same manner as in Example 1. The evaluation results are shown in Table 5.

EXAMPLE 8

Respectively electrically insulating yellow toner particles, magenta toner particles and black toner particles were prepared by using C.I. Pigment Yellow 17, C.I. Pigment Red 202 and graft carbon black, respectively, as the colorants, otherwise in the same manner as in Example 1.

The characterizing parameters of the respective color toners are summarized in the following Table 4 together with those of the cyan toner particle prepared in Example 1.

TABLE 4

| Toner particles | DW (μm) | $A_{VN}$ (%) | SF-1 | SF-2 | Outer shell resin Mw | Outer shell resin Mn | Volume resistivity (ohm · cm) |
|---|---|---|---|---|---|---|---|
| Cyan (Ex. 1) | 6 | 27 | 104 | 108 | $7 \times 10^4$ | $2 \times 10^4$ | $\geqq 10^{14}$ |
| Yellow | 6 | 27 | 104 | 108 | $7 \times 10^4$ | $2 \times 10^4$ | $\geqq 10^{14}$ |
| Magenta | 6 | 27 | 104 | 108 | $7 \times 10^4$ | $2 \times 10^4$ | $\geqq 10^{14}$ |
| Black | 7 | 27 | 104 | 108 | $7 \times 10^4$ | $2 \times 10^4$ | $\geqq 10^{14}$ |

100 wt. parts of each color of toner particles were blended with 1.2 wt. parts of hydrophobized inorganic fine powder (a-1) and 0.8 wt. part of hydrophobic silicon compound fine powder (A) to prepare the respective color toners. Each color toner (inclusive of cyan toner) in 6 wt. parts was blended with 94 wt. parts of resin-coated magnetic ferrite carrier particles having an average particle size of 50 μm to 4 two-component type developers for magnetic brush development.

The thus-prepared respective color developers were charged in respective developing devices of a commercially available full-color copying machine ("CLC-500", mfd. by Canon K.K.) remodeled so that the silicone oil application rate was set to 0.02 g/A4-size and subjected to continuous image formation of a full-color-mode while replenishing the respective color toners as required. As a result, the respective color toners all showed a high transfer ratio and provided good full-color copy images. During the continuous image formation test, no cleaning failure occurred but good full-color copy images were continually obtained. The evaluation results of the yellow toner, magenta toner and black toner were also evaluated in a single-color mode and provided results as shown in Table 5.

EXAMPLE 9

Respective color toners prepared in Example 1 and Example 8 were formulated in the same manner as in Example 1 into the two-component type developers of respective colors, which were then introduced into the respective developing devices 74-1, 74-2, 74-3 and 74-4 for image formation by magnetic brush development to form toner images of respective colors. The toners of the respective color images showed triboelectric charges in the range of −15 to −18 mC/kg. The toner images of the respective colors formed on the photosensitive member 1 were successively transferred to an intermediate transfer member 75 and further transferred to a transfer-receiving material 76 (plain paper having a basis weight of 199 g/m$^2$) to form superposed four-color toner images on the transfer-receiving material 76 which were then heat-fixed by a hot-pressure fixing means 81. After each of the above transfer of the color toner images from the intermediate transfer member 75 to the transfer-receiving material 76, the surface of the intermediate transfer member 75 was successively cleaned by a cleaning member 80.

Each of the thus formed four color toner images showed a high transfer efficiency including a transfer ratio ($T_1$) (from the photosensitive member 71 to the intermediate transfer member 75) of 97–99%, a transfer ratio ($T_2$) (from the intermediate transfer member 75 to the transfer-receiving material 76) of 99%; and an overall transfer ratio ($T_{overall}$) (from the photosensitive member to the transfer-receiving material through the intermediate transfer member) of 96–98%. The resultant toner image was also excellent in color-mixing characteristic and was a high quality image free from a hollow image.

Further, when double-side image formation was performed, any occurrence of an offset phenomenon on both sides of a transfer-receiving material was not observed.

When a continuous copying test of 50,000 sheets was performed, an image density of the resultant image was not changed between at an initial stage and after the durability test and toner sticking onto the respective member of the image forming apparatus was not observed.

FIG. 7 shows a schematic sectional view of an image forming apparatus used in this example.

A photosensitive member 71 comprising a support 1*a* and a photosensitive layer 71*b* disposed thereon containing an organic photoconductor was rotated in the direction of an arrow and charged so as to have a surface potential of about −600 V by a charging roller 72 (comprising an electroconductive elastic layer 72*a* and a core metal 72*b*). An electrostatic image having a light (exposure) part potential of −100 V and a dark part potential of −600 V was formed on the photosensitive member 1 by exposing the photosensitive member 71 to light-image 73 by using an image exposure means effecting ON and OFF based on digital image information through a polygonal mirror. The electrostatic image was developed with yellow toner particles, magenta toner particles, cyan toner particles or black toner particles contained in plural developing units 74-1 to 74-4 by using reversal development to form color toner images on the photosensitive member 71. Each of the color toner images was transferred to a intermediate transfer member 75 (comprising an elastic layer 75*a* and a core metal 75*b* as a support) to form thereon a superposed four-color image. Residual toner particles on the photosensitive member 71 after the transfer were recovered by a cleaning member 78 into a residual toner container 79.

The intermediate transfer member 75 was formed by applying a coating liquid for the elastic layer 75*a* comprising carbon black (as an electroconductivity-imparting material) sufficiently dispersed in acrylonitrile-butadiene rubber (NBR) onto a pipe-like core metal 75*b*. The elastic layer 75*a* of the intermediate transfer member 75 showed a hardness of 30 as measured by JIS K-6301 and a volume resistivity of $10^9$ ohm.cm. The transfer from the photosensitive member 71 to the intermediate transfer member 75 was performed by applying a voltage of +500 V from a power supply to the core metal 75*b* to provide a necessary transfer current of about 5 μA.

The transfer roller 7 having a diameter of 20 mm was formed by applying a coating liquid for the elastic layer 7*a* comprising carbon (as an electroconductivity-imparting material) sufficiently dispersed in a foamed ethylenepropylene-diene terpolymer (EPDM) onto a 10 mm dia.-core metal 7*b*. The electrostatic layer 7*a* of the transfer roller 7 showed a hardness of 35 as measured by JIS K-6301 and a volume resistivity of $10^6$ ohm.cm. The transfer from the intermediate transfer member 5 to the transfer-receiving material 6 was performed by applying a voltage to the transfer roller 7 to provide a transfer current of 15 $\mu$A.

The results of evaluation of the respective color toners performed by a single color mode.

Comparative Example 14

Respective color toners were prepared in the same manner as in Example 9 except for using hydrophobized inorganic fine powder (a-1) and hydrophobized silicon compound fine powder (C) as external additives and were evaluated in the same manner as in Example 9. The evaluation results are shown in Table 5.

Comparative Example 15

Respective color toners were prepared in the same manner as in Example 9 except for using only hydrophobized inorganic fine powder (a-1) and hydrophobized silicon compound fine powder (C) as an external additive and were evaluated in the same manner as in Example 9. The evaluation results are shown in Table 5.

EXAMPLE 10

| | |
|---|---|
| Styrene monomer | 160 wt. parts |
| n-Butyl acrylate monomer | 40 wt. parts |
| Hydrophobized magnetic iron oxide (Dav. = 0.25 $\mu$m; $\sigma_s$ = 65 emu/g, $\sigma_r$ = 12 emu/g, and Hc = 115 oersted at 10 k-oersted) | 95 wt. parts |
| Styrene/methacrylic acid - methyl methacrylate (85/5/10 by weight) copolymer | 11 wt. parts |
| Divinylbenzene | 3 wt. parts |
| Di-t-butylsalicylic acid metal compound | 3 wt. parts |
| Low-molecular weight polypropylene wax (m.p. = 70° C.) | 15 wt. parts |

The above ingredients were heated at 60° C. and uniformly dissolved and dispersed by using a TK-homomixer rotating at 12,000 rpm. To the mixture, 9 wt. parts of 2,2'-azobis(2,4-dimethylvaleronitrile) (polymerization initiator) was added to prepare a polymerizable monomer composition.

Separately, 150 wt. parts of 0.1 M-$Na_3PO_4$ aqueous solution was added to 650 wt. parts of deionized water, and the system was heated to 60° C. and stirred at 12,000 rpm by a TK-homomixer. To the system, 75 wt. parts of 1.0 M-$CaCl_2$ aqueous solution was gradually added to prepare an aqueous medium containing $Ca_3(PO_4)_2$.

To the aqueous medium, the above-prepared polymerizable monomer composition was added, and the system was stirred by a TK-homomixer at 10,000 rpm at 60° C. in an $N_2$-atmosphere to form particles of the polymerizable monomer composition. Then, the system was stirred by paddle-stirring blades and heated to 80° C. for 10 hours of reaction. After the completion of the polymerization, the system was cooled, followed by addition of hydrochloric acid for dissolving the calcium phosphate, filtration, washing with water and drying, to recover magnetic toner particles.

The thus-obtained magnetic toner particles showed a weight-average particle size of 6.5 $\mu$m, a particle size variation coefficient ($A_{VN}$) of 25%, SF-1=105, and SF-2=109.

100 wt. parts of the magnetic toner particles were blended with 1.1 wt. parts of hydrophobized inorganic fine powder (a-1) and 0.7 wt. part of hydrophobized silicon compound fine powder (A) to prepare a magnetic toner.

The magnetic toner was subjected to a continuous image formation test on $5\times10^4$ sheets by using a commercially available electrophotographic copying machine ("NP-8582", available from Canon K.K.) to evaluate the fixability, anti-offset characteristic, cleanability, toner triboelectric charge, image density change and image quality change. The results are shown in Table 5.

TABLE 5

| Example or Comp. Example | Continuous image formation test on 5 × $10^4$ sheets: Image density initial | Image density last | Transfer ratio initial (%) | Transfer ratio last (%) | Cleaning failure initial | Cleaning failure last | Embedding of additive | $T_{FI}$ (%) | Anti-offset $T_{OL}$ (°C.) | Anti-offset $T_{OH}$ (°C.) | Anti-block | T.C. (mc/kg L/L | T.C. N/N | T.C. H/H |
|---|---|---|---|---|---|---|---|---|---|---|---|---|---|---|
| Ex. 6 | 1.50 | 1.48 | 93 | 91 | none | none | none | 130 | 130 | 210 | ○ | −30 | −27 | −26 |
| Ex. 7 | 1.50 | 1.48 | 95 | 93 | do. | do. | do. | 130 | 130 | 210 | ○ | −31 | −28 | −27 |
| Ex. 8 | | | | | | | | | | | | | | |
| yellow | 1.50 | 1.49 | 97 | 95 | do. | do. | do. | 130 | 125 | 220 | ○ | −30 | −28 | −26 |
| magenta | 1.50 | 1.49 | 97 | 95 | do. | do. | do. | 130 | 125 | 220 | ○ | −30 | −27 | −25 |
| black | 1.50 | 1.51 | 97 | 95 | do. | do. | do. | 130 | 125 | 220 | ○ | −30 | −28 | −25 |
| Ex. 9 | | | | | | | | | | | | | | |
| cyan | 1.50 | 1.48 | 97 | 95 | do. | do. | do. | 130 | 125 | 220 | ○ | −30 | −28 | −26 |
| yellow | 1.50 | 1.47 | 97 | 95 | do. | do. | do. | 130 | 125 | 220 | ○ | −30 | −29 | −26 |
| magenta | 1.50 | 1.48 | 98 | 95 | do. | do. | do. | 130 | 125 | 220 | ○ | −31 | −29 | −25 |
| black | 1.50 | 1.49 | 97 | 95 | do. | do. | do. | 130 | 125 | 220 | ○ | −30 | −27 | −24 |
| Comp. Ex. 14 | | | | | | | | | | | | | | |
| cyan | 1.51 | 1.40 | 89 | 85 | do. | 17000 | occurred | 130 | 125 | 220 | ○ | −42 | −36 | −25 |
| yellow | 1.50 | 1.41 | 88 | 83 | do. | 17000 | do. | 130 | 125 | 220 | ○ | −43 | −35 | −27 |
| magenta | 1.50 | 1.40 | 89 | 81 | do. | 17000 | do. | 130 | 125 | 220 | ○ | −44 | −34 | −26 |
| black | 1.51 | 1.41 | 87 | 81 | do. | 17000 | do. | 130 | 125 | 220 | ○ | −45 | −33 | −27 |

TABLE 5-continued

| Example or Comp. Example | Continuous image formation test on 5 × $10^4$ sheets: Image density initial | Image density last | Transfer ratio initial (%) | Transfer ratio last (%) | Cleaning failure initial | Cleaning failure last | Embedding of additive | $T_{FI}$ (%) | Anti-offset $T_{OL}$ (°C.) | Anti-offset $T_{OH}$ (°C.) | Anti-block | T.C. (mc/kg L/L | T.C. (mc/kg N/N | T.C. (mc/kg H/H |
|---|---|---|---|---|---|---|---|---|---|---|---|---|---|---|
| Comp. Ex. 15 | | | | | | | | | | | | | | |
| cyan | 1.45 | 1.34 | 94 | 77 | do. | 1000 | do. | 130 | 125 | 220 | ○ | −43 | −36 | −23 |
| yellow | 1.45 | 1.34 | 94 | 77 | do. | 1000 | do. | 130 | 125 | 220 | ○ | −42 | −37 | −21 |
| magenta | 1.44 | 1.34 | 93 | 78 | do. | 1000 | do. | 130 | 125 | 220 | ○ | −41 | −38 | −24 |
| black | 1.45 | 1.34 | 94 | 76 | do. | 1000 | do. | 130 | 125 | 220 | ○ | −42 | −33 | −22 |
| Ex. 10 | 1.49 | 1.48 | 97 | 95 | do. | none | none | 150 | 145 | 190 | ○ | | | |

What is claimed is:

1. A toner for developing electrostatic images comprising:

(a) toner particles having a weight-average particle size of 1–9 μm;

(b) hydrophobized inorganic fine powder having an average particle size of 10–90 nm and being formed from a material selected from the group consisting of titanium oxide, aluminum oxide, strontium titanate, cerium oxide, magnesium oxide, silicon nitride, silicon carbide, calcium sulfate, barium sulfate, calcium carbonate, and fluorinated carbon; and (c) hydrophobized silicon compound fine powder comprising hydrophobized fine powder of silica or silicone resin;

wherein the hydrophobized silicon compound fine powder has (i) an average particle size of 30–120 nm, and (ii) a particle size distribution such that it contains 15–45% by number of particles having sizes of 5–30 nm, 30–70% by number of particles having sizes of 30–60 nm and 5–45% by number of particles having sizes of at least 60 nm.

2. The toner according to claim 1, wherein said toner particles have a shape factor SF-1 of 100–150 and a shape factor SF-2 of 100–140.

3. The toner according to claim 2, wherein said toner particles have a shape factor SF-1 of 100–140 and a shape factor SF-2 of 100–130.

4. The toner according to claim 3, wherein said toner particles have a shape factor SF-1 of 100–130 and a shape factor SF-2 of 100–125.

5. The toner according to claim 1, wherein said toner particles have a weight-average particle size of 2–8 μm.

6. The toner according to claim 1, wherein said hydrophobized inorganic fine powder has an average particle size of 20–80 nm.

7. The toner according to claim 1, wherein said hydrophobized inorganic fine powder comprises hydrophobized titanium oxide fine powder.

8. The toner according to claim 1, wherein said toner particles comprise toner particles prepared by polymerizing in an aqueous medium a polymerizable monomer mixture including a polymerizable monomer, a release agent and a colorant.

9. The toner according to claim 8, wherein said toner particles comprise a binder resin, the release agent and the colorant.

10. The toner according to claim 9, wherein said toner particles contain 10–40 wt. parts of the release agent per 100 wt. parts of the binder resin.

11. The toner according to claim 8, wherein said toner particles have a shape factor SF-1 of 100–150 and a shape factor SF-2 of 100–140.

12. The toner according to claim 11, wherein said toner particles have a shape factor SF-1 of 100–140 and a shape factor SF-2 of 100–130.

13. The toner according to claim 12, wherein said toner particles have a shape factor SF-1 of 100–130 and a shape factor SF-2 of 100–125.

14. The toner according to claim 8, wherein said toner particles have a weight-average particle size of 2–8 μm, and said hydrophobized inorganic fine powder has an average particle size of 20–80 nm.

15. The toner according to claim 1, comprising 0.05–3.5 wt. parts of the hydrophobized inorganic fine powder and 0.05–1.5 wt. parts of the hydrophobized silicon compound fine powder per 100 wt. parts of the toner particles.

16. The toner according to claim 8, wherein said release agent comprises a material selected from the group consisting of paraffin wax, polyolefin wax, amide wax, ester wax and polymethylene wax.

17. The toner according to claim 1, wherein said hydrophobized silicon compound fine powder contains 45–70% by number of particles having sizes of 30–60 nm.

18. The toner according to claim 17, wherein said hydrophobized silicon compound fine powder contains 50–70% by number of particles having sizes of 30–60 nm.

19. The toner according to claim 1, wherein said hydrophobized inorganic fine powder has an absolute value of triboelectric charge of at most 45 mC/kg, and said hydrophobized silicon compound fine powder as an absolute value of triboelectric charge of 50–300 mC/kg.

20. The toner according to claim 19, wherein said hydrophobized inorganic fine powder has an absolute value of triboelectric charge of at most 30 mC/kg, and said hydrophobized silicon compound fine powder as an absolute value of triboelectric charge of 70–250 mC/kg.

21. The toner according to claim 1, wherein said hydrophobized inorganic fine powder has a hydrophobicity of 20–80%, and said hydrophobized silicon compound fine powder has a hydrophobicity of 30–80%.

* * * * *

UNITED STATES PATENT AND TRADEMARK OFFICE

CERTIFICATE OF CORRECTION

PATENT NO. : 5,827,632

DATED : October 27, 1998

INVENTOR(S) : KOHJI INABA, ET AL.

It is certified that error appears in the above-indentified patent and that said Letters Patent is hereby corrected as shown below:

On the title page, item

[56] REFERENCES CITED

FOREIGN PATENT DOCUMENTS

"56-61842 4/1984 Japan" should read --59-61842 4/1984 Japan--.

OTHER PUBLICATIONS

In "Lee et al.", "Temperaturs" should read -- Temperatures--.

COLUMN 3

Line 26, "member" should read --member,--.

COLUMN 4

Line 22, "A or AVN(%)=[S/$D_1$/X100," should read --A or AVN(%)=[S/$D_1$/X100]--.

UNITED STATES PATENT AND TRADEMARK OFFICE

CERTIFICATE OF CORRECTION

PATENT NO. : 5,827,632

DATED : October 27, 1998

INVENTOR(S) : KOHJI INABA, ET AL.

It is certified that error appears in the above-indentified patent and that said Letters Patent is hereby corrected as shown below:

COLUMN 8

Line 40, "form" should read --from--; and
Line 45, "my" should be deleted.

COLUMN 10

Line 10, "free-" should read --freeze--.

COLUMN 11

Line 48, "alsopol" should read --also be--.

COLUMN 12

Line 24, "liable" should read --liable to--; and
Line 67, "back side" should read --backside--.

COLUMN 14

Line 9, "is" should be deleted.

UNITED STATES PATENT AND TRADEMARK OFFICE

CERTIFICATE OF CORRECTION

PATENT NO. : 5,827,632

DATED : October 27, 1998

INVENTOR(S) : KOHJI INABA, ET AL.

It is certified that error appears in the above-indentified patent and that said Letters Patent is hereby corrected as shown below:

COLUMN 19

Line 32, "to high" should read -- to achieve high--.

COLUMN 22

Line 32, "performed" should read --be performed--; and
Line 46, "film-may" should read --film may--.

COLUMN 23

Line 47, "has" should read --have--.

COLUMN 24

Line 37, "characteristic" should read --Characteristic--; and
Line 66, "measured evaluated" should read --evaluated--.

UNITED STATES PATENT AND TRADEMARK OFFICE

CERTIFICATE OF CORRECTION

PATENT NO. : 5,827,632

DATED : October 27, 1998

INVENTOR(S) : KOHJI INABA, ET AL.

It is certified that error appears in the above-indentified patent and that said Letters Patent is hereby corrected as shown below:

COLUMN 25

Line 16, "characteristic" should read --Characteristic--;
Line 18, "leftstanding" should read --left standing--;
Line 23, "quality" should read --Quality--;
Line 38, "charge in three environments" should read --Charge in Three Environments--;
Line 40, "leftstanding" should read --left standing--; and
Line 66, "while." should read --while--.

COLUMN 26

Line 12, "density" should read --Density--.

COLUMN 27

Line 32, "an" should read --and--.

COLUMN 35

Table 5, In Ex. 8 "black 1.50" should read --black 1.51--.

UNITED STATES PATENT AND TRADEMARK OFFICE

CERTIFICATE OF CORRECTION

PATENT NO. : 5,827,632

DATED : October 27, 1998

INVENTOR(S) : KOHJI INABA, ET AL.

It is certified that error appears in the above-indentified patent and that said Letters Patent is hereby corrected as shown below:

COLUMN 38

Line 53, "as" should read --has--; and
Line 58, "as" should read --has--.

Signed and Sealed this

Twenty-sixth Day of October, 1999

*Attest:*

*Attesting Officer*

Q. TODD DICKINSON

*Acting Commissioner of Patents and Trademarks*